US011788288B2

(12) United States Patent
Daton-Lovett

(10) Patent No.: US 11,788,288 B2
(45) Date of Patent: Oct. 17, 2023

(54) SLIT LOCKING CLAMP FOR MAST AND SUPPORT ASSEMBLY

(71) Applicant: RTL Materials Ltd., Lymington (GB)

(72) Inventor: Andrew Daton-Lovett, Lymington (GB)

(73) Assignee: RTL MATERIALS LIMITED, Lymington (GB)

( * ) Notice: Subject to any disclaimer, the term of this patent is extended or adjusted under 35 U.S.C. 154(b) by 722 days.

(21) Appl. No.: 16/641,477

(22) PCT Filed: Aug. 3, 2018

(86) PCT No.: PCT/GB2018/052237

§ 371 (c)(1),
(2) Date: Feb. 24, 2020

(87) PCT Pub. No.: WO2019/038515

PCT Pub. Date: Feb. 28, 2019

(65) Prior Publication Data

US 2021/0156148 A1 May 27, 2021

(30) Foreign Application Priority Data

Aug. 22, 2017 (GB) ..... 1713482

(51) Int. Cl.

| | |
|---|---|
| ***E04C 3/00*** | (2006.01) |
| ***H01Q 1/08*** | (2006.01) |
| ***E04C 3/07*** | (2006.01) |

(52) U.S. Cl.

CPC ..... *E04C 3/005* (2013.01); *E04C 3/07* (2013.01); *H01Q 1/087* (2013.01)

(58) Field of Classification Search

CPC ... E04C 3/005; E04C 3/28; E04C 3/07; B64G 1/222; H01Q 1/087

See application file for complete search history.

(56) References Cited

U.S. PATENT DOCUMENTS 3,361,377 A * 1/1968 Trexler, Jr. ..... E04C 3/005 242/918
3,360,894 A 2/1968 Sharman et al.
(Continued)

FOREIGN PATENT DOCUMENTS

EP 0319921 A 6/1989
GB 2517991 A 3/2015
(Continued)

OTHER PUBLICATIONS

International Search Report dated Nov. 14, 2018 (Nov. 14, 2018) in corresponding International Patent Application No. PCT/GB2018/052237.

*Primary Examiner* — Babajide A Demuren
*Assistant Examiner* — Daniel J Kenny
(74) *Attorney, Agent, or Firm* — Troutman Pepper Hamilton Sanders LLP

(57) ABSTRACT

A mast assembly (10), a method of deploying a mast (20), a slit locking clamp (50) for a mast and to a support assembly (14) for an extendible member (20) are provided. The mast assembly (10) comprises an extendible mast (20) configurable between a coiled form and an extended form. When extended the mast is resiliently biased in the form of an elongate tube having a slit along its length defined by longitudinal edges of the mast. When coiled the mast is opened out at the slit to a flattened cross section and wound about an axis extending transversely to the longitudinal extent of the mast. A slit locking clamp (50) clamps across the slit in the mast at a position along the length of the mast so as to stabilise one edge relative to the other.

16 Claims, 11 Drawing Sheets

(56) References Cited

U.S. PATENT DOCUMENTS

| | | | | | |
|---|---|---|---|---|---|
| 3,434,674 | A * | 3/1969 | Groskopfs | H01Q 1/087 | 242/390.2 |
| 3,499,610 | A * | 3/1970 | Hamlin | E04C 3/005 | 242/390.2 |
| 3,589,632 | A * | 6/1971 | Rew | F16H 19/064 | 436/805 |
| 3,811,633 | A * | 5/1974 | Cummings | B29C 53/20 | 226/173 |
| 4,991,784 | A * | 2/1991 | Schmid | B65H 23/02 | 242/585 |
| 5,765,320 | A * | 6/1998 | Hamy | H01Q 1/087 | 52/108 |
| 6,112,474 | A * | 9/2000 | Paine | E04H 12/185 | 248/161 |
| 9,404,256 | B2 * | 8/2016 | Adams | E04C 3/005 | |
| 10,196,817 | B2 * | 2/2019 | Rakow | E04C 3/005 | |
| 2015/0368903 | A1 * | 12/2015 | Turse | B65H 75/4402 | 242/407 |
| 2016/0177567 | A1 * | 6/2016 | Gandhi | B64G 99/00 | 29/897.33 |

FOREIGN PATENT DOCUMENTS

| | | | |
|---|---|---|---|
| WO | 8808620 | A1 | 11/1988 |
| WO | 9308671 | A1 | 4/1993 |
| WO | 9608671 | A1 | 3/1996 |
| WO | 9735706 | A1 | 10/1997 |
| WO | 9962811 | A1 | 12/1999 |
| WO | 9962812 | A1 | 12/1999 |

* cited by examiner

SLIT LOCKING CLAMP FOR MAST AND SUPPORT ASSEMBLY

This application is a national phase filing under 35 U.S.C. § 371 of International Patent Application No. PCT/GB2018/052237, filed Aug. 3, 2018, which claims the benefit of British Patent Application No. 1713482.6, filed Aug. 22, 2017, each of which is incorporated herein by reference in its entirety.

The present invention relates to a mast assembly, a method of deploying a mast, a slit locking clamp for a mast and to a support assembly for an extendible member.

Slit tubular structures, generically known as STEMs, have been used since the 1950's as an alternative to telescopic or jointed devices to provide for extendable members from a small initial envelope. They consist of longitudinally slit tubes, which can be opened along the slit line and coiled for compact storage or driven between the coiled and extended forms to provide a driven arm, mast or boom.

In the 1990's, devices commonly referred to as bi-stable reeled composites (BRCs), as described in WO97/35706 came into general use. These manage the problems of difficult handling and complicated mechanism by forming STEM type structures from materials that have been engineered so as to make them easy to coil and handle, in particular many of them exhibit a stable geometry in both the extended and coiled states.

These bi-stable tubes have been in use masts for supporting apparatus and antenna supports since the early 2000's. Large numbers are used in current theatres of operations by the UK, US and other armed forces, as they offer the means to transport antenna masts in much smaller spaces than telescopic, jointed or articulated rods or tubes. This allows, for example, a five metre mast used with the UK Armed Forces "Bowman" communications system to be carried in a rucksack side-pouch. Their simplicity and absence of joints also means they are much less likely to fail in the field, where sticking joints or local damage to telescope sections commonly cause failure as a result of alternating hot and cold weather conditions or relatively minor impact incidents.

However, despite the advantages offered by the use of STEMs and bistable tubes as masts in deploying apparatus and other load supporting applications, when larger STEMs are deployed difficulties may arise in keeping the structure stable both during deployment and in its final position. When larger loads are deployed, this may cause a hazard to the person deploying the mast, who typically may be directly underneath the load as it is extended upwards and therefore potentially vulnerable to injury in the case of failure, as well as damaging the mast. This may necessitate additional people assisting with stabilising the mast as another manipulates the mast from its coiled to its extended form.

The present invention aims to provide improved ways of deploying slit tube members.

According to a first aspect of the present invention, there is provided a mast assembly, comprising:

an extendible mast constructed and arranged so as to be configurable between a coiled form and an extended form, wherein when extended the mast is resiliently biased in the form of an elongate tube having a slit along its length defined by longitudinal edges of the mast and wherein when coiled the mast is opened out at the slit to a flattened cross section and wound about an axis extending transversely to the longitudinal extent of the mast; and, at least one slit locking clamp for clamping across the slit in the mast at a position along the length of the mast so as to stabilise one edge relative to the other.

Thus, the slit locking clamp acts to prevent local shear between the edges. This has been found to be a primary source of instability in all STEM type masts. Once the point is reached where there is a relatively high local stiffness in the wall of the mast, due to the increasing diameter allowing a relative increase in wall thickness and stiffness, then locally fixing the edges relative to each other can make a significant contribution to the global strength and stiffness of a STEM mast. This allows masts of increased lengths and diameters to become feasible and for supporting heavier loads in demanding applications and environments. One or more clamps may be added to the mast as it is progressively uncoiled. Thus, the mast can be stabilised as it is deployed, such that fewer personnel are required to safely deploy the mast in demanding applications.

The clamps are preferably reversible, allowing the mast assembly to be re-stowed.

"Mast" as used herein should be intended to cover any elongate structural member, e.g. for use supporting, positioning or actuating some equipment, sensor, etc. either alone or in combination with other masts or apparatus, such as booms, beams, poles, antennas etc., or for acting as a conduit, or any application where an extendible tubular member is deployed where structural demands are made on the member as it is extended and/or retracted and/or deployed.

Clamps may be applied at discrete local positions at suitable separations along the length of the mast to achieve stabilisation of the edges along substantially the entire length and so globally strengthen the mast. The precise separation of clamps will depend on the clamping method, the properties of the mast, and the expected loads. Nonetheless, it is envisaged that for most applications, e.g. for fibre reinforced polymer STEMS, for a mast in excess of 5 meters, clamps be positioned so that no length of the mast greater than 4 meters is left unconstrained by a clamp or any other constraint (e.g. an end cap or the coil). In some applications, e.g. where the mast is erected vertically, the clamps are positioned so that the spacing of positions of constraint is decreased towards the coil end of the mast due to the higher load at the coil end of the mast due to its weight.

In an embodiment, the slit locking clamp has at least one feature for engaging with a corresponding feature of the mast on one or both sides of the slit to resist axial movement of one edge relative to the other when clamping the mast. A positive mechanical engagement between the clamp and tube through some feature of the mast engaging, e.g. butting against or interlocking with, some feature of the clamp may provide enhanced resistance to local shear of the edges compared with a clamp that operates by friction alone, and may be preferred in applications where particular strength is required. Features on the mast arrange to provide a positive interlock with the clamp may be localised to correspond with the desired location or locations of the clamps with the rest of the mast having the conventional smooth cross sectional profile (i.e. STEM walls with regular thickness or no abrupt discontinuations of thickness) or edge profile. Nonetheless, the features may be provided at plural, continuous or closely spaced positions, giving the user a choice of positions to apply the clamp or clamps, e.g. providing a plurality of adjacent clamping positions separated by a distance less than the width of the mast. Where it is not acceptable to introduce features into the structure of the mast itself which would disrupt its regular thickness, the longitudinal slit may be preferred to act as the feature in the mast. Where the only feature in the mast used for engagement with the clamp is the regular straight edges of the STEM, the clamp can of course be attached at an position along the length of the STEM, which may be an advantage in some applications.

In an embodiment, at least one feature of the clamp comprises a protrusion which is received by a corresponding hole or recess on the mast and/or at least one feature of the clamp is a hole which receives a corresponding protrusion of the mast. Thus, for instance, the clamp may have protrusions, such as projecting pins or the like, that engage with corresponding holes or recesses in the wall of the STEM. The interlocking helps prevent relative axial movement of the edges, i.e. local shear. It is preferred that such features are provided on both sides of the slit such that the interlocking occurs for both edges, leading to increased stability.

In an embodiment, at least one feature of the clamp is a longitudinal feature arranged to fit in the slit and maintain separation of the edges of the mast when clamped. This engagement between the feature and the edges may provide some frictional braking resisting relative axial movement of the edges, particularly where the clamp acts to compress the slit tube in the hoop such that the edges are urged against the feature. In addition, by maintaining the slit at a constant width it helps prevent any local micro-buckling around the circumference of the tube which helps increase torsional rigidity in conjunction with any other interlocking features present in the embodiment.

In an embodiment, the longitudinal feature has a profile arranged to interlock with corresponding indents or relief portions at the edges of the tube. This serves to increase the interlocking of the edges by keying the edges to the profile of the longitudinal feature. Any "toothed" profile will be suitable for this purpose.

In an embodiment, the longitudinal feature extends through the slit and widens forming grooves which receives the edges of the slit. This helps provide support to the edges and helps keep them aligned in a radial direction, and so further helps prevent micro buckling and other distortions of the tube under load.

In an embodiment, the clamp has engaging features that have an axial separation or, where continuous, extend axially for a distance equal to at least 75% of the diameter of the tube. Thus, interlocking the edges to the clamp over a significant axial distance (compared with the diameter of the tube, or maximum diameter where the tube is not circular) along the mast is advantageous in preventing shear between the edges. Thus, where interlocking projections and holes are used as locking features, it is preferred that on each side of the slit, at least two projections and holes are used axially separated by at least this distance. This effectively "triangulates" the locking of the clamp to the edge of the member, to prevent relative rotation of the edge to the clamp locally. Alternatively or additionally, the longitudinal feature positioned in the slit can be made to extend over this distance for similar reason. Where the features are holes or recesses formed in the walls, rather than the edges, of the mast, it is generally preferred to have plural discrete features axially separated, rather than a continuous slot, so as to retain as much as possible the strength of the mast wall by reducing the material removed. In contrast, where the features are recesses or reliefs in the edges of the mast, it may be preferred to have these run continuously.

In some embodiments, where it is desired to minimise local shear between the edges, it may be preferable to increase the separation of the features to 120% of the diameter of the tube or more. There is no particular upper limit to this distance, but it is envisaged that there will be no worthwhile increase in the ability to resist local shear beyond a separation of about 200% of the diameter of the mast, to compensate for the increased size of the clamp.

In an embodiment, the clamp comprises first and second collar members pivoted relative to each other, such that they can be opened out to encircle the tube, and a fixture arranged to join the other ends of the collar members to form a collar around the tube. A collar may generally be preferred in supporting the wall of the mast through potentially 360 degrees of its circumference, thus helping stabilise the mast and prevent micro buckling. This also provides a convenient point to attach tethers or other apparatus to the mast at any one or more circumferential point. This may be particularly effective where a longitudinal feature of the clamp is inserted into the slit in the tube, as the collar can act to constrain the edges against this feature thereby further stabilising the mast. The collar can be fixed with a clamping force around the tube against the resilient bias of the tube to increase the friction developed between the clamp and the tube when resisting distortion of the tube edges.

In an embodiment, the clamp comprises a first plate spanning the slit external to the wall of the mast and a second plate internal to the wall of the mast and at least partially overlapping with the first plate, and a clamp mechanism extending through the slit and operable to clamp together the walls of the mast between the first and second plates. In contrast with using a collar arrangement, a face-to-face clamp may be preferred because of its smaller size. Also, for some masts, some other desired aspect of their construction may prevent a collar completely enclosing the mast. In this case, it is preferred to provide more locking features to stabilise the edges. For instance, interlocking protrusions and holes/recesses, as described above, may be required to hold the slit in the tube at a constant width to prevent local buckling, rather than solely relying on a feature interlocking with an edge profile of the mast. A clasp, cam mechanism, screw mechanism or any other suitable closure mechanism can be used between the plates to urge together and lock the plates to clamp the walls of the mast.

In an embodiment, an internal surface of the clamp is adapted to follow the external profile of the mast. Thus, the surface of the clamp contacts and supports the corresponding wall of the mast with which it makes contact when clamping the mast, thereby helping stabilise the walls of the mast and preventing local buckling when clamping the mast. This is generally preferred both for the collar embodiment and the face-to-face clamp embodiment where the faces of both plates that contact the surface of the mast preferably follow the profile of those surfaces.

In an embodiment, friction between the clamp and the mast acts to resist axial movement of one edge relative to the other. In some embodiments, the friction generated by the clamp may be sufficient to provide the desired resistance to local shear of the edges and so stabilise the mast. In some embodiments, interlocking features may not be necessary in addition to this frictional clamping. It is envisaged that embodiments where the clamp forms a collar round the tube will work best with a friction only arrangement, possibly combined with a longitudinal feature as described above.

In an embodiment, the mast assembly comprises plural clamps at different axial positions along the length of the mast. Placing regular clamps along the mast can help stabilise the mast over longer distances. The clamps can be attached as the mast is progressively extended, as part of the deployment process.

In an embodiment, at least one clamp has an attachment feature for connecting at least one tether to help stabilise the mast when deployed.

In an embodiment, the mast assembly comprises a dispenser holding the coiled mast.

In an embodiment, the mast assembly may include an antenna positioned and supported by the mast. For instance, the antenna may be integrally formed with the mast, so that it co-coils with the mast, or it may be separate and attached to the mast prior to deployment. In other embodiments, other apparatus may be attached to the mast to position and support the apparatus in use. The mast can in principle be used to support any desired load where a strong and rigid beam, boom, prop, etc. is required.

According to a second aspect of the present invention, there is provided a method of deploying a mast assembly, the method comprising:

extending a mast from a coiled form to an extended form, wherein when extended the mast is resiliently biased in the form of an elongate tube having a slit along its length defined by edges of the mast and wherein when coiled the mast is opened out at the slit to a flattened cross section and wound about an axis extending transversely to the longitudinal extent of the mast; and clamping at least one slit locking clamp across the slit in the mast at an intermediate position along the length of the mast so as to stabilise one edge relative to the other before further extending the mast.

The method may comprise offering up the clamp to the mast such that at least one locking feature of the clamp is aligned with and engages with a corresponding feature of the of the mast before closing the clamp.

The method may comprise closing a collar of the slit locking clamp around the extended mast. Thus, the clamp can be applied at any point along the extended mast by opening the collar, e.g. via a pivot, offering it up to the mast, closing the collar around the mast and locking it via some fixture, e.g. a clasp.

The method may comprise offering up the clamp to the mast in the direction of extension at a point where the mast transitions from its flattened cross section to its tubular cross section and the edges come together to form the slit, such that a first plate of the clamp passes exterior to the mast and a second plate of the clamp pass interior to the mast until the clamp reaches the desired position along the mast, and then operating a clamp attaching the first plate to the second plate through the slit in the tube to clamp the edges of the mast between the first and second plates. Thus, where clamp is of the face-to-face type where a plate is required to be positioned inside to the mast, this can be introduced at the point where the edges of the walls of the mast come together at the desired clamping position as the mast is being extended. This may be preferred to trying to prise apart the edges of the mast to position the clamp at a point where the mast is already extended and forms a slit tube.

The method may comprise clamping the mast at plural positions along its length as it is extended.

The method may comprise extending the coiled member from dispenser and operating a brake of a dispenser to lock the mast at a desired height. A brake can similarly be used to stop the mast at an intermediate position where it is desired to clamp the mast before further extending it to its desired final height.

In another aspect, the mast can be stowed by reversing the steps.

According to another aspect of the present invention, there is provided a slit locking clamp for locking the edges of a slit tubular extendible member having at least one feature for engaging with a corresponding features of the slit tubular member on both sides of the slit to resist axial movement of one edge relative to the other when clamping the slit tubular member.

According to another aspect of the present invention, there is provided a support assembly for supporting an extendible member in a deployed configuration in which it is part extended from a coil, wherein when extended the member is resiliently biased in the form of an elongate tube having a slit along its length defined by edges of the mast and wherein when coiled the mast is opened out at the slit to a flattened cross section and wound about an axis extending transversely to the longitudinal extent of the mast, comprising: at least one support element arranged to contact and support a portion of the extendible member in the quadrant under the coil and adjacent where the extendible member transitions from its coiled to its extended form.

It has been noted that a possible mode of failure of a partially deployed STEM mast, i.e. one still partially coiled, is that the downward load on the STEM is sufficient to force the first turn off the coil at the base leading to failure. Masts with a larger diameter have a greater width across the coil and this may reach the point where the stressed areas is exposed to sufficient force for the mast to flex and fail under the load. The support assembly provides a support element to help support the coil in the quadrant where it transitions from the coiled to the extended form, which helps the mast resist greater loads and more hostile conditions than would otherwise be possible. The support may be provided under the mast, i.e. in line with the load acting on the mast on the extrados face of the coil, and extend generally towards the coil to help support this section of the coil at the point of maximum stress. The support assembly may be provided in the form of a standalone support assembly, where the mast is deployed to the desired extent manually before the support assembly is fitted to the already partially extended mast, or in the form of dispenser for the mast, which retains the coiled member and allows the coil to rotate so that the mast can extend, e.g. including a spool for holding the coil. The support element may be one or more of a plate, roller, rod, wheel, etc., extending partially or fully across the width of the member or any combination of these.

In embodiments, where the support assembly is provided in a dispenser, it may be arranged such that the portion of mast between the coiled portion and the extended portion is unconstrained in its ability to extend or retract, i.e. the coil can be manually extended and conversely loads the support elements acting on the mast will be transferred to the coil, without the support elements or other elements resisting this motion (except in embodiments where the support element also acts as a brake as discussed below). In other words, the support elements provide a reactive force to support the mast in the transition between coiled and extended under load. Here, the support will generally be underneath the last coil as it begins to extend, e.g. behind the rotational axis of the coil. This allows the mast to be easily extended/retracted without requiring additional force so that manual operation is possible.

In an embodiment, the profile of the support element or elements in contact with the extendible member is curved to match the profile of the member where contact is made. Preferably the profile in contact with the member extends over a reasonable longitudinal length of the member, e.g. equal to at least half the width of the coil. This helps extend the surface area over which the member provides support.

In an embodiment, at least a first support element on the extrados face of the member and at least a second support element on the intrados face of the member opposite the at least a first support element so as to form a channel through which the extensible member passes. This channel or slot helps further constrain this section of the member and further helps prevents twisting and buckling modes of failure.

In an embodiment, the assembly may comprise a positioning element arranged to position the coil such that said portion of the extendible member contacts the at least one support member. For a standalone support assembly, the positioning element may be a member opposing the first support element such that at least one coil of the member is retained between the two elements. Alternatively, a further element, fixed relative to the first support element, may extend further around underneath the coil, i.e. into the other quadrant under the coil, such that the coil is prevented from rolling away from and out of contact with the first support element. When incorporated into a dispenser, this positioning element may be a spool or a coil shaped envelope in the housing for holding the coil and allowing it to rotate, optionally with a brake to selectively prevent further rotation when the mast is deployed.

In an embodiment, the assembly may comprise a brake operable to prevent further extension and/or retraction of the member. The brake may engage with the extendible member or with the spool on which it is coiled.

In an embodiment, at least one support element is at least partially movable to engage with the extendible member to serve as the brake. Thus, combining support with a braking function may help simplify the dispenser and reduce the number of parts. The support member may move to clamp the extendible member against an opposite support member or against the residual coils in order to brake the extendible member. The support member may be drawn in towards the centre of rotation of the coil along a radius, from outer to inner, such that the position of the support member maintains support of the extendible member at the same position on the transition point as the member extends.

In an embodiment, the movable support element is movable to clamp the extendible member to an opposing support element or to the coil. Where the movable support element clamps against an opposing support element, then this opposing support element may be fixed in position relative to the housing.

In an embodiment, the support element is partially movable in that it comprises a cam which pivots to clamp the extendible member to an opposing support element or to the coil.

In an embodiment, the assembly comprises a housing for the member in coiled form and permitting the end of the member to be dispensed from the coil; and a spool rotationally fixed to the housing on which the extendible member is coiled in the housing, wherein the movable support member engages with the side wall of the spool to resist further rotation of the spool. Thus the extending side walls can have one or more slit/recess in side wall which can engage with the support member at corresponding rotational positions of the spool.

In other aspects, the invention relates to supporting and/or dispensing an extendible member with a support assembly as described above.

In an embodiment, the mast or member described above comprises a reinforced composite. Thus, the mast can be made from layers of fibre reinforced polymer or the like. In an embodiment, the mast comprises a bistable material. It is anticipated that these materials will be preferred materials for forming the mast in many applications.

In embodiments, any of the methods described above may be used with the mast according to any example or embodiment described herein. The support assembly described above can be used with the mast assembly and slit locking clamp as described above to achieve enhanced stability and security in erecting masts.

It will be appreciated that any features expressed herein as being provided "in one example" or as being "preferable" or an embodiment may be provided in combination with any one or more other such features together with any one or more of the aspects of the present invention.

Embodiments of the present invention will now be described by way of example with reference to the accompanying drawings, in which.

Figure 1:
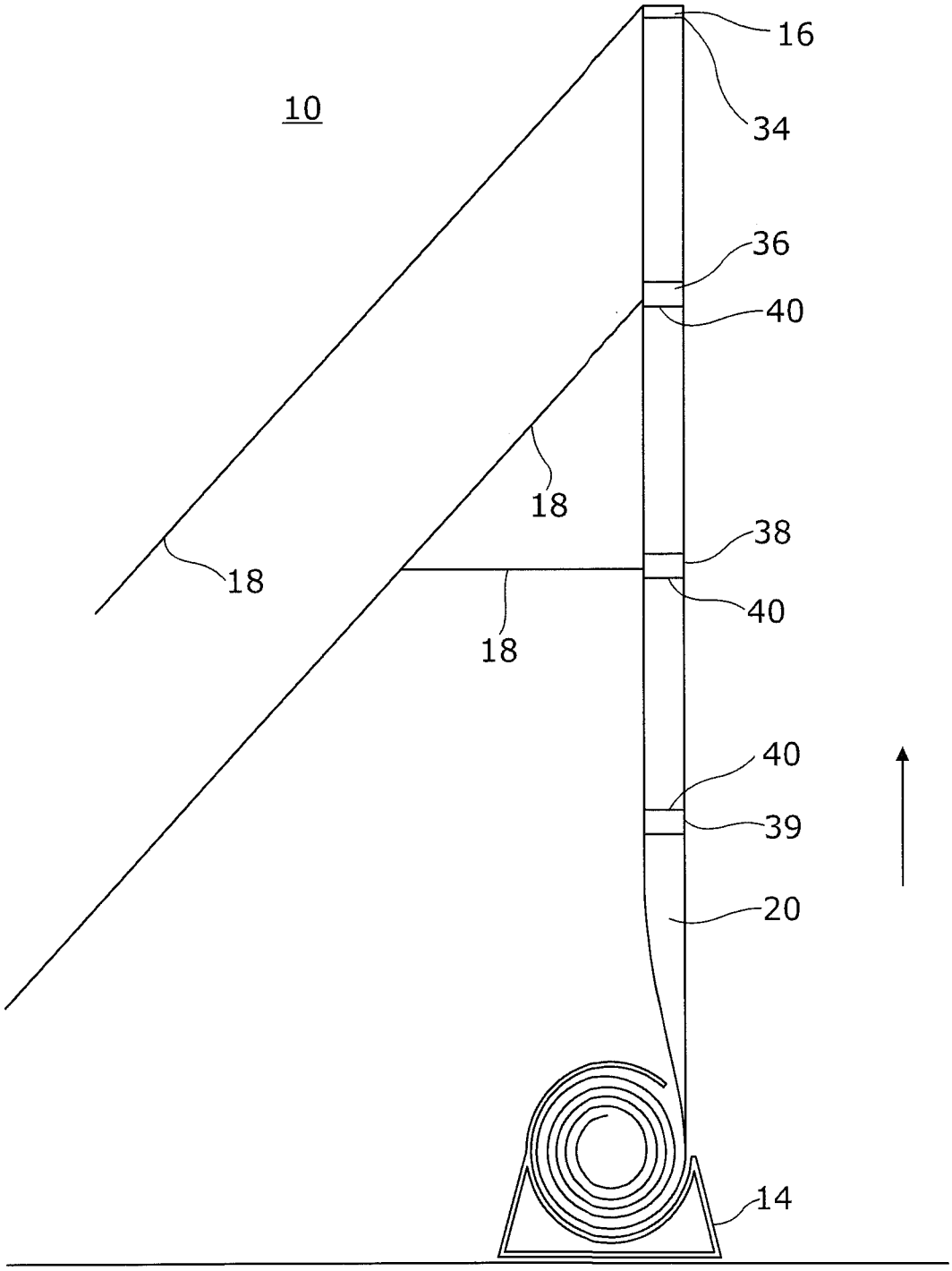
FIG. 1 shows a perspective view of an example of a mast assembly according to an embodiment of the present invention.

FIG. 1 shows an example of a mast assembly 10. The assembly 10 includes a mast 20. References made herein to the longitudinal or axial direction of the mast 20 or mast assembly generally refer to the direction in which the mast is extended. The assembly 10 comprises a dispenser 14 from which the mast 20 is deployed, which may rest on the ground or be affixed to a suitable surface. A top cap 16 is attached to the top of the mast 20 and one or more slit locking clamps are attached along the length of the mast 20. Optionally, tethers 18 are attached the top cap 16 and/or to the slit locking clamps and are pinned to the ground to help anchor the antenna assembly 10 in place. Alternatively, the assembly 10 may not have a dispenser 14. As will be described below, where a dispenser is not used, other supports may be provided for the coiled end of the mast. Where the mast is fully deployed, i.e. fully extended from the coil, a bottom cap may be used to support the base of the mast.

The mast 20 in this example incorporates an integral antenna formed from one or more antenna elements along some or all of its length. The assembly 10 has a connector by which connection can be made at a convenient point to the assembly 10 by a cable, e.g. a co-axial cable, for connecting the antenna assembly 20 to a communication system. Where the connector is at some distance from the antenna, the mast may include a cable to electrically connect the two.

The mast 20 has the form of a slit tubular extendible member (STEM). NB "mast" and "STEM" are generally used interchangeably in the following to refer to the extensible member. Thus, as shown in more detail in FIG. 2, the mast 20 is formed of an elongate member of sheet-like material, i.e. the member is thin in cross section, e.g. typically between 1 mm and 5 mm. The member can be opened out into a flat form allowing it to be wound into a coil 11. The extended portion 12 is resiliently biased to have a cross section that is curved, in this example, in the form of a circle or partial circle. Thus when fully extended, the member is resiliently biased in the form of a slit tube. The sides of the tube may meet or overlap to form a full tube, or a gap may be left. Cross sections other than circular may be used. For example, ovals and other continuous, non-circular arcs for the cross section can also be produced. The cross section may have straight portions between curved portions whilst being generally curved. The antenna is integral with the extendible mast so as to be able to coil and uncoil with the mast 20. Various techniques for doing this are described in the following disclosure.

Figure 2:
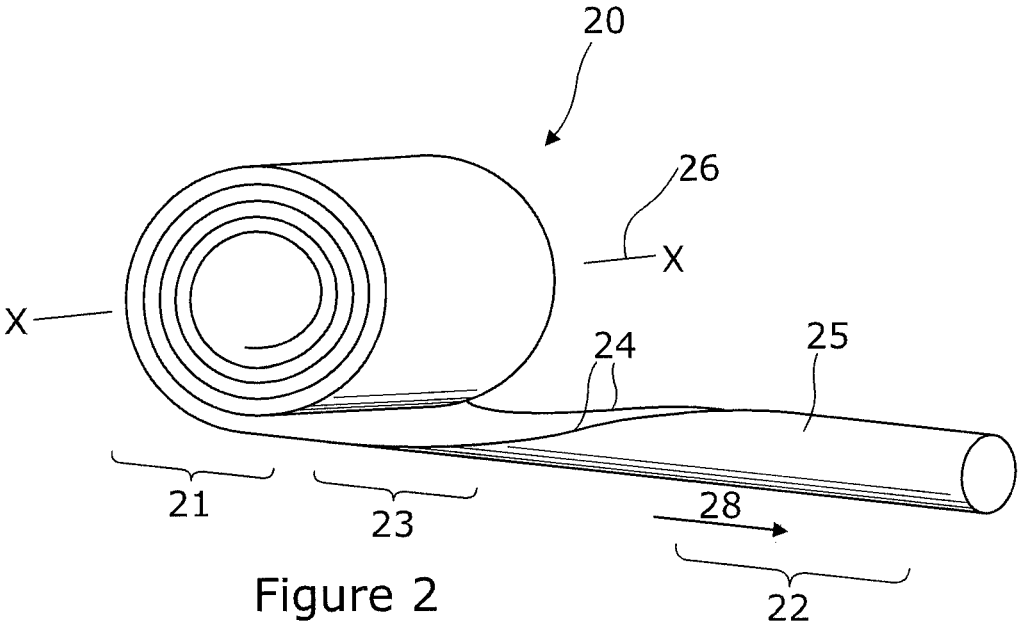
Figure 2 (Prior Art)
FIG. 2 shows a perspective view of an example of a STEM suitable for use with the mast assembly of FIG. 1.

FIG. 2 shows an example of extendible member suitable for use with the various embodiments of the present invention in providing the mast 20. The member 20 can be reconfigured between a coiled state 21 and an extended state 22, via a transition stage 23. In the extended state 22 the member is generally elongated and biased to have a curved or non-linear cross section in a direction transverse to the longitudinal axis 28 of the member. (References to longitudinal axis or longitudinal extent or direction of extension in this document generally refer to this axis 28). This curvature can be adapted and thus the cross section of the extended portion can comprise anything from a closed or substantially closed circular shape, or other generally closed shapes. The member 20 is resiliently biased in this curved cross section when extended. This gives structural rigidity to the member 20 when extended. In the coiled state 21 the member 20 is generally opened out at the longitudinal slit 25 formed by the side edges 24 to have a flat cross section, and is coiled around an axis 26 that is transverse to the longitudinal axis 28 of the member 20. The member 20 is thin in cross section to aid coiling, e.g. typically between 0.5 mm and 5 mm for most applications. Such members are sometimes referred to as STEMs (slit tubular extendable members).

The member 20 can be made from various materials suitable for transitioning between a flat, coiled form and an extended, slit tube form, and being resiliently biased in the slit tube form. In general, plastics are contemplated as being suitable materials, although others are possible. In the present example, the member 20 comprises a composite material having a thermoplastic matrix with fibre reinforcements, such as a fibre reinforced polymer ("FRP" hereafter). The fibres may be glass, carbon, or aramid, while the polymer may be polypropylene, polyethylene, a polyamide, polyester thermoplastic, poly-ether-ether-ketone or any other polymer suited to the particular requirements of the task at hand. The composite material may comprise a single layer or plural layers with fibres oriented in different directions in each lamina. The use of fibrous materials mechanically enhances the strength and elasticity of the plastic matrix. The extent that strength and elasticity are enhanced in a fibre reinforced plastic depends on the mechanical properties of both the fibre and the matrix, their volume relative to one another, and the fibre length and orientation within the matrix. FRPs are widely used in many areas such as aerospace and automotive industries, and are not described in detail herein.

In the present example, the member 20 is a bistable reelable composite (BRC). Such a bistable member 20 has a first stable state in the coiled form 21, where the cross section of the member 20 is generally flat and a second stable state in the extended form 22, where the cross section of the member is curved as previously described. The bistable member 20 may be capable of reversible configuration between its coiled and extended forms a plurality of times. Suitable structures are disclosed in the following international patent applications, each of which is incorporated here by reference: WO A 88/08620, WO-A-97/35706, WO-A-99/62811, and WO-A-99/62812. Such bistable structures are available from RolaTube Technology Limited of Lymington, the United Kingdom.

In general, two ways may be used to make a tube bistable; either by altering the bending stiffnesses of the structure so that it is no longer isotropic, for instance by using a fibre-reinforced composite, or by setting up an initial prestress in the structure. The BRC in the present example uses the first technique. This involves arranging the fibres to increase the torsional stiffness, and increase the coupling between bending in the longitudinal and transverse directions. This can be achieved by ensuring that in the surface layers of the BRC, i.e. those offset from the midplane of the BRC, stiff fibres are angled relative to the longitudinal axis, e.g. at ±45°. A simple example is the anti-symmetric [+45°/−45°/0°/+45°/−45°] fibre lay-up.

In engineering terms these surface layers have high Poisson's ratios. It is well known that as a curved shell is straightened the inner surface gets longer and the outer surface gets shorter. Thus, when a section of the extended tube is opened, as the initial curvature straightens, the surface fibres are deformed which, due to their high Poisson's ratio, exert a force acting to curve the opened section longitudinally into its coiled form. The tube coils with same sense curvature, i.e. the centre of curvature is on the same side of the structure in both forms.

Normally when something is bent the amount of energy stored by that bending (the total strain energy) rises as the degree of bending increases. In BRCs, once the initial curvature is straightened as the tube is opened, the stiffness along the longitudinal axis drops and the forces acting on the material of the tube arising by the deformed surface fibres can act to flip it into the coiled form. As this second curves forms, the total strain energy drops, thereby forming a second stable form for this section.

These principle operate in reverse when moving from the coiled state to the extended state.

Thus, structural members are formed that exhibit a stable geometry in both the extended and coiled states. These manage the problems of difficult handling and complicated mechanisms by forming STEM type structures from materials that have been engineered so as to make them easy to coil and handle.

Figure 3:
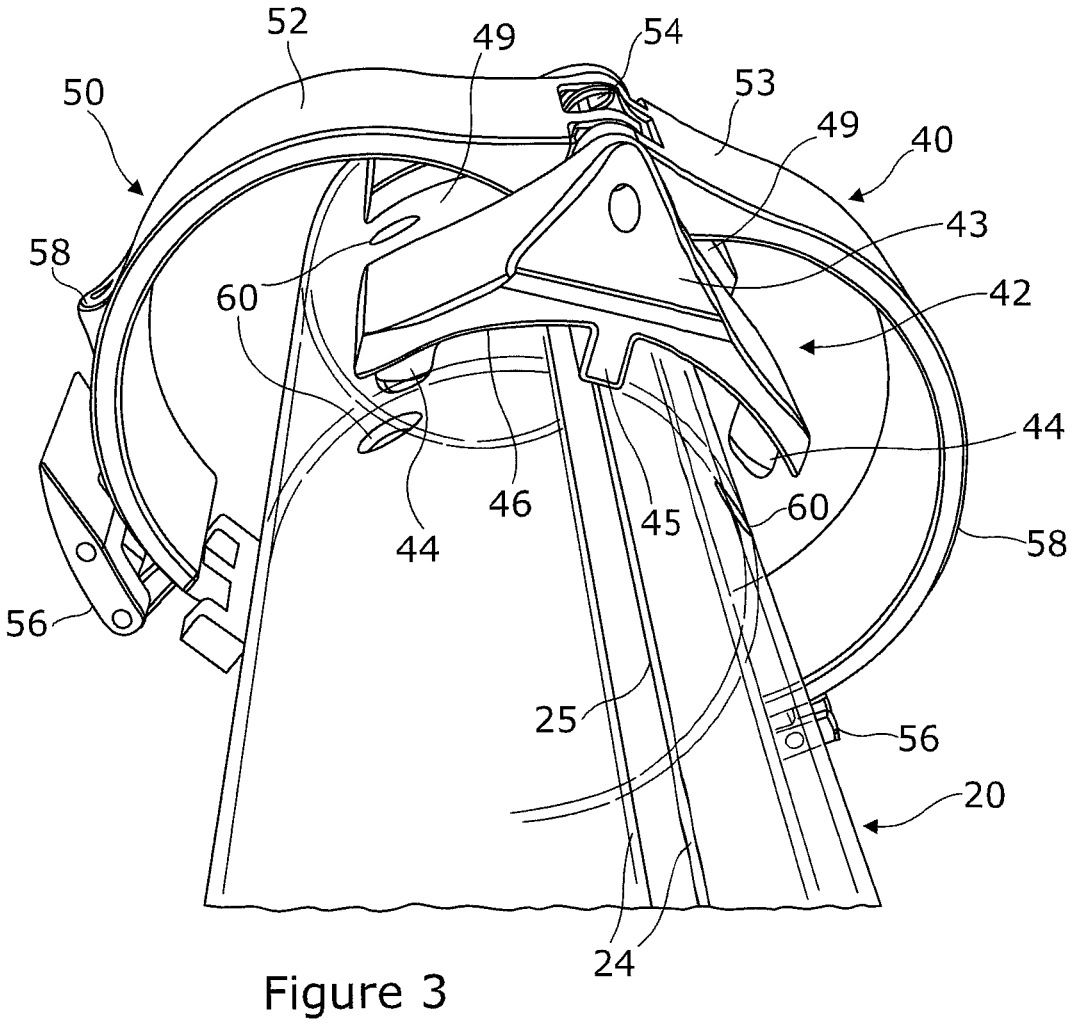
FIG. 3 shows a perspective view of an example of a slit locking clamp according to an embodiment of the present invention and suitable for use in the mast assembly of FIG. 1 prior to engagement with a STEM.

FIG. 3 shows a perspective view of an example of a slit locking clamp suitable for use in the mast assembly of FIG. 1 prior to engagement with a STEM. The slit locking clamp 40 comprises an engagement portion 42 and a locking portion 50. The engagement portion 42 is adapted to engage with features of the STEM to stabilise the edges 24 of the STEM and the locking portion 44 is adapted to lock the clamp 40 in place. In the present example, the engagement portion 42 comprises a body 43 having four protrusions 44, such as pins, that are positioned and shaped to correspond to four holes 60 in the wall of the mast 20 with a close fit. The engagement portion 42 also has a protruding longitudinal feature 45 positioned and shaped to fit into the slit 25 of the STEM and engage with the edges 24. The inner surface 46 of the body 43 is generally shaped to conform to the surface profile of the STEM where it is to clamp in place, e.g. it is arcuate in cross section where the cross section of the mast 2 is circular, as in the present example, although it will be appreciated that the clamp can be adapted to fit a mast with any cross section.

In this example, the protrusions 44 and holes 60 are generally arranged in a square form, with two protrusions/holes either side of the slit 25. Other numbers and arrangements of protrusions and corresponding holes are possible, but it is preferred in most contemplated applications to have at least one protrusion and corresponding hole on each side of the slit 25, and more preferably at least two protrusions/holes either side of the slit particularly in cases where the longitudinal feature 45 is omitted (e.g. where the STEM has overlapping edges). The protrusions are preferably well separated along the length, increasing the holding force along the axis by minimizing any rotation of the collar relative to the axis. For example, the protrusions may be separated along the length by a distance of at least 75% of the largest diameter of the tube, and more preferably by 120% or more of the largest diameter. This arrangement helps stabilise the side edges of the STEM. This depends primarily on the four pins locating in holes in the wall of the STEM but is also assisted by the feature sitting in the STEM's slit. Although this is unlikely to provide much frictional braking, by maintaining the slit at a constant width it helps prevent any local micro-buckling around the circumference and react with the pins to increase torsional rigidity.

The holes are preferably relatively large compared to the wall thickness of the tube to help distribute stresses around the hole, with the protrusions closely fitting within the holes 60. For instance, the hole 60 may be at least 200% of the thickness of the wall, and more preferably 500% or more. In principle, any shape can be used for the holes 60. However, smooths shapes, such as circles or ellipses or the like, are generally preferred to reduce stresses in the material.

The locking portion 50 comprises a two part collar 52,53, both parts of which are hinged to the body 43 at their proximal ends by a pivot, and a clasp 56. The inner surface of the collar 52,53 conform to the surface profile of the mast 20 where it is to clamp in place such that the collar parts 52,53 can pivot together to form a collar around the STEM 20. The clasp 56 can then be engaged to secure together the distal ends of the collar parts 52,53 thus forming a collar around the STEM 20 and keeping the overall clamp in place. The clasp 56 can be an over centre clasp to bring the ends together with a desired degree of clamping force to tightly secure the clamp in place.

In the present example, the body 43 has a recess 49 on each side to accommodate the collar parts 52,53 when they are clamped around the STEM 20 to achieve a low profile.

The clamp 40 may have features 58 adapted for securing guy ropes 18 to tether the mast 20 in place or for securing equipment to the mast 20.

Figure 4:
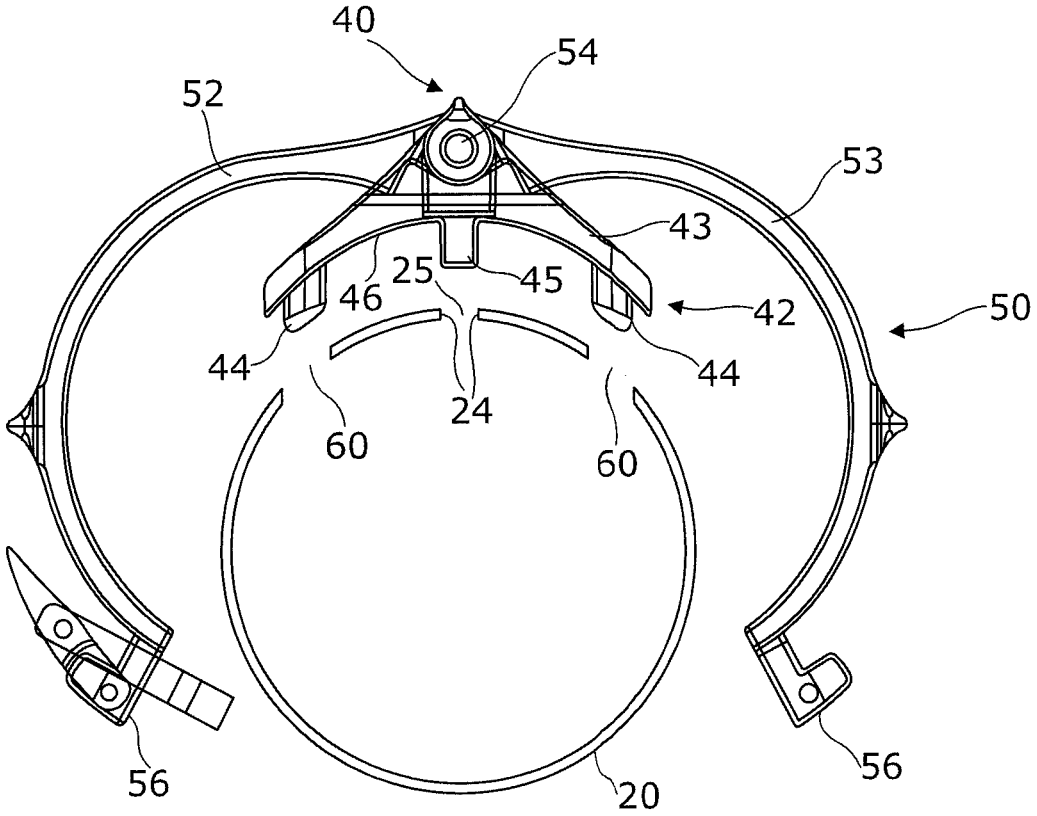
FIG. 4 shows in cross section the example of FIG. 3.
Figure 5:
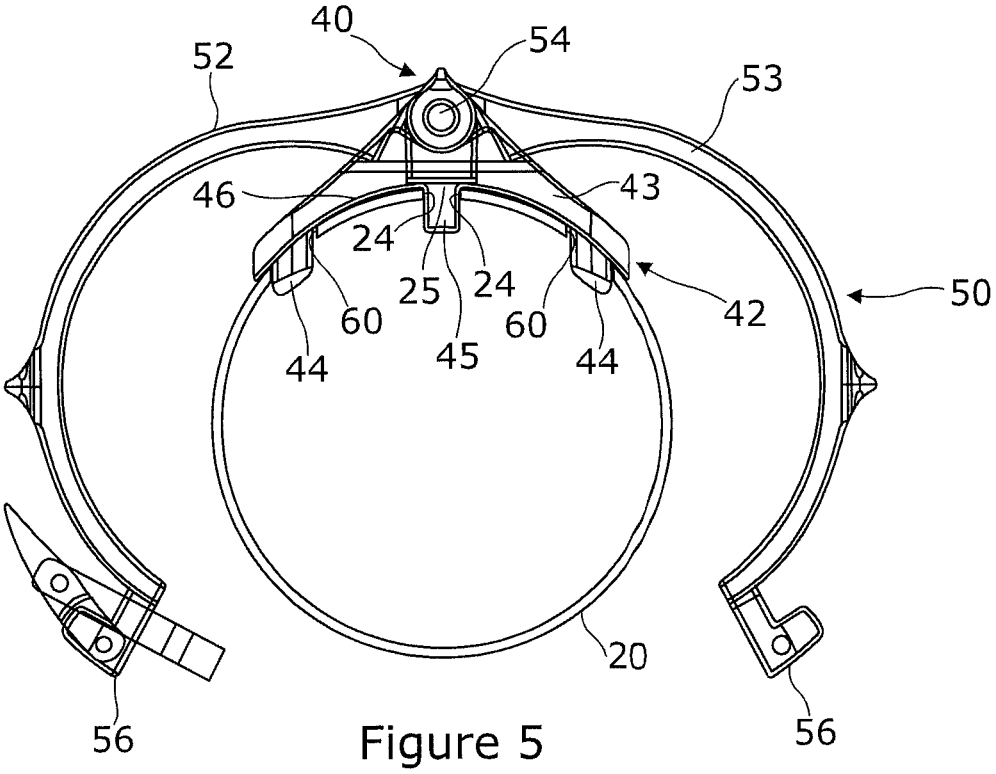
FIG. 5 shows in cross section the example of FIG. 3 with the clamp engaged with the STEM.
Figure 6:
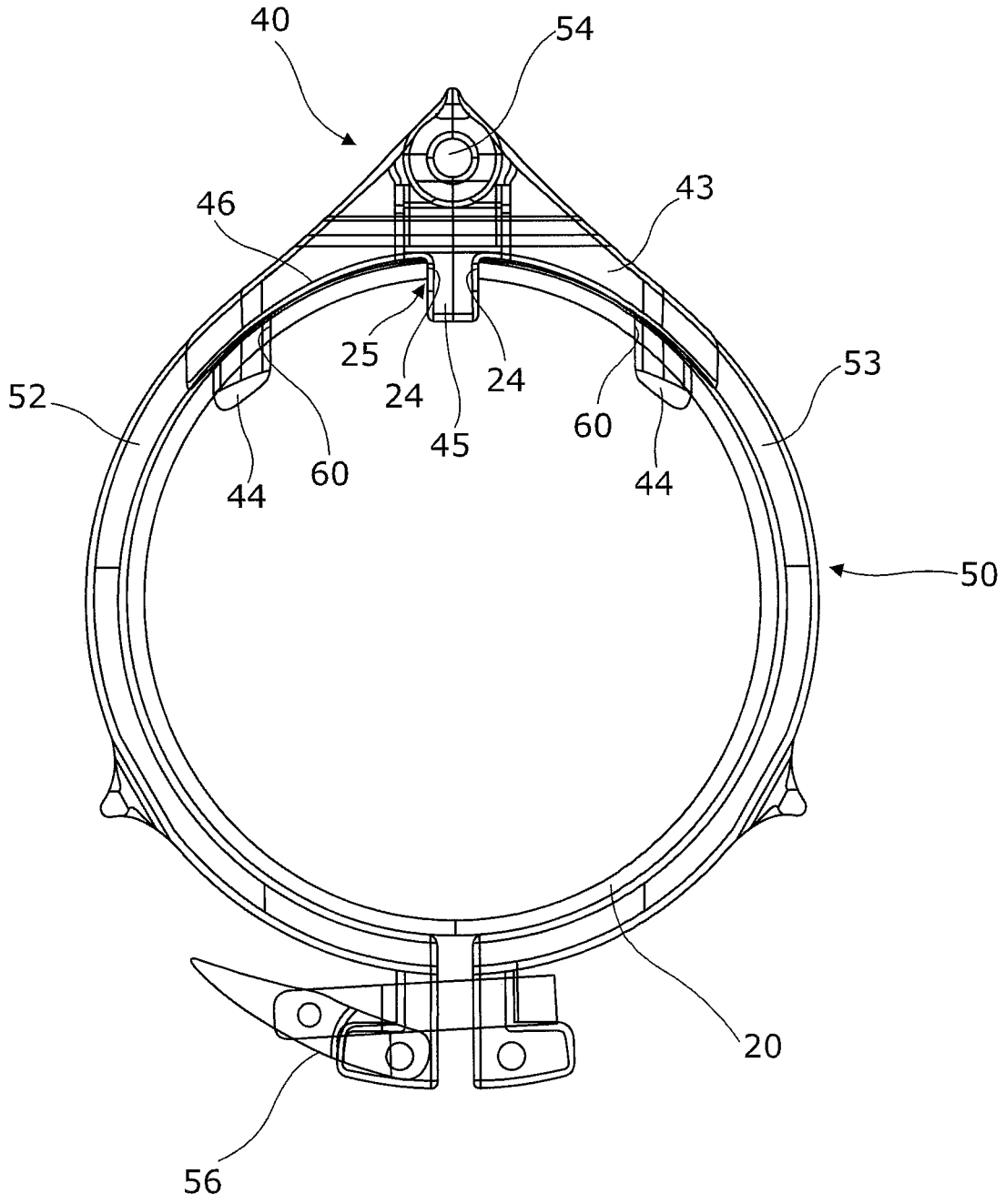
FIG. 6 shows in cross section the example of FIG. 3 with the clamp engaged with and clamping the STEM.

FIGS. 4 to 6 show the procedure for clamping the STEM 20. In FIG. 4, the collar 52,53 is opened out at the pivot 54 so the engagement portion 42 is offered up to the STEM 20. As shown in FIG. 5 the protrusions 44 engage with the holes 50, the engagement surface 46 lies against the surface of the STEM 20 bridging the slit 25, and the longitudinal feature 45 engages with the edges 24 of the STEM in the slit 25. The edges of the mast may have to be manually pushed together to achieve the right gap width. As shown in FIG. 6, the two part collar 52,53 is closed around the STEM 20 and the over centre clasp 56 closed to lock the clamp in place. The clamp 40 can be removed by reversing the procedure.

Referring back to FIG. 1, the entire mast assembly 10 can be deployed from an initial state where the mast 20 is entirely coiled within the dispenser 14 and the top cap 16, clamps 40 and any tethers not yet attached to the mast 20. In this state the mast assembly 10 can be compactly stowed for storage or transport. To deploy the mast assembly 10, a user can place the dispenser 14 on the ground or any suitable surface and begin to extend 28 the end 34 of the mast 20 from the spool 14 assembly, e.g. either manually or by a drive mechanism included with the spool 14. The end cap 16 can be affixed on the end 34 of the mast 20 at the beginning of the process. As the mast 20 extends, when an attachment point 36,38,39 of the mast is reached, the user can attach a clamp 40 around the mast 20 as described in relation to FIGS. 4 to 6 and any tethers 18 attached. The mast 20 can be stowed by reversing the procedure.

The clamp 40 effectively restrains the relative lateral motion of the edges 24 of the STEM 20 as well as stabilising the STEM 20 in the hoop and preventing buckling, thus stabilising the mast assembly 10. This allows larger masts 10 to be erected more stability than previously possible, and may make erection by a single user more practical. For example, the illustrated mast can be 10 cm in diameter and 10 m in length, with clamps 40 at 3.36 m, 5.75 m, and 8 m positions 36,38,39 respectively from the top 34 of the mast 20. The clamps 40 at the top two positions 36,38 have a triangulated tether, whilst the clamp 40 at the bottom 39 has not tether. Tethers may be used at two or more circumferential positions on the mast 20 to help support it (FIG. 1 shows only tethers 18 on one side of the mast assembly 10 for simplify).

Other forms of the clamp 40 can be used provide this locking and stabilising effect.

Looking at the function of the device, it can be seen that anything that provides a similar holding force will have the same effect. This will include anything in which one or more features on the wall or edge of the STEM reacts against a feature on a collar or clamp, either by interlocking in some way or by friction.

For instance, a clamp 40 with no interlocking features 60,45 which simply clamps around the STEM and stabilises the edges 24 by friction could achiever similar results. Nonetheless, a clamp 40 with additional interlocking features, designed to interlock with one or more features on the wall or edges of the STEM device, such as to prevent motion of the axial edges of the STEM relative to each other, such as the slit feature 45 or the protrusions 60, will add further stability and may be preferred for reliability in the field, or more demanding applications.

The principles by which the clamps interlock can generally be categorised as the following types:

1. A collar with feature/s which locate into hole/s or indent/s on the wall of the STEM
2. A clamp with feature/s which locate into hole/s or indent/s on the wall of the STEM
3. A collar with feature/s that sit against, and/or which locate into feature/s in, the axial edges of the STEM
4. A clamp with feature/s that sit against, and/or which locate into feature/s in, the axial edges of the STEM
5. The inverse of the above, where the interlocking is between cavities/indents in the collar/clamp and features protruding from the wall or edge of the STEM.

Or any combination of the above.

The principles developed herein apply to other STEMs, whether having overlapping edges or edges any angle subtended along the axis with a slit running down between the edges. Where the edges overlap, a longitudinal feature 45 will not be able to sit in the slit and may be omitted from the device.

The current device uses a collar arrangement that clamps around the circumference of the STEM and is representative of a combination of type 1 and type 3, in that the raised central rib sits against the edges increasing the total holding force applied to the edges relative to each other.

Figure 7:
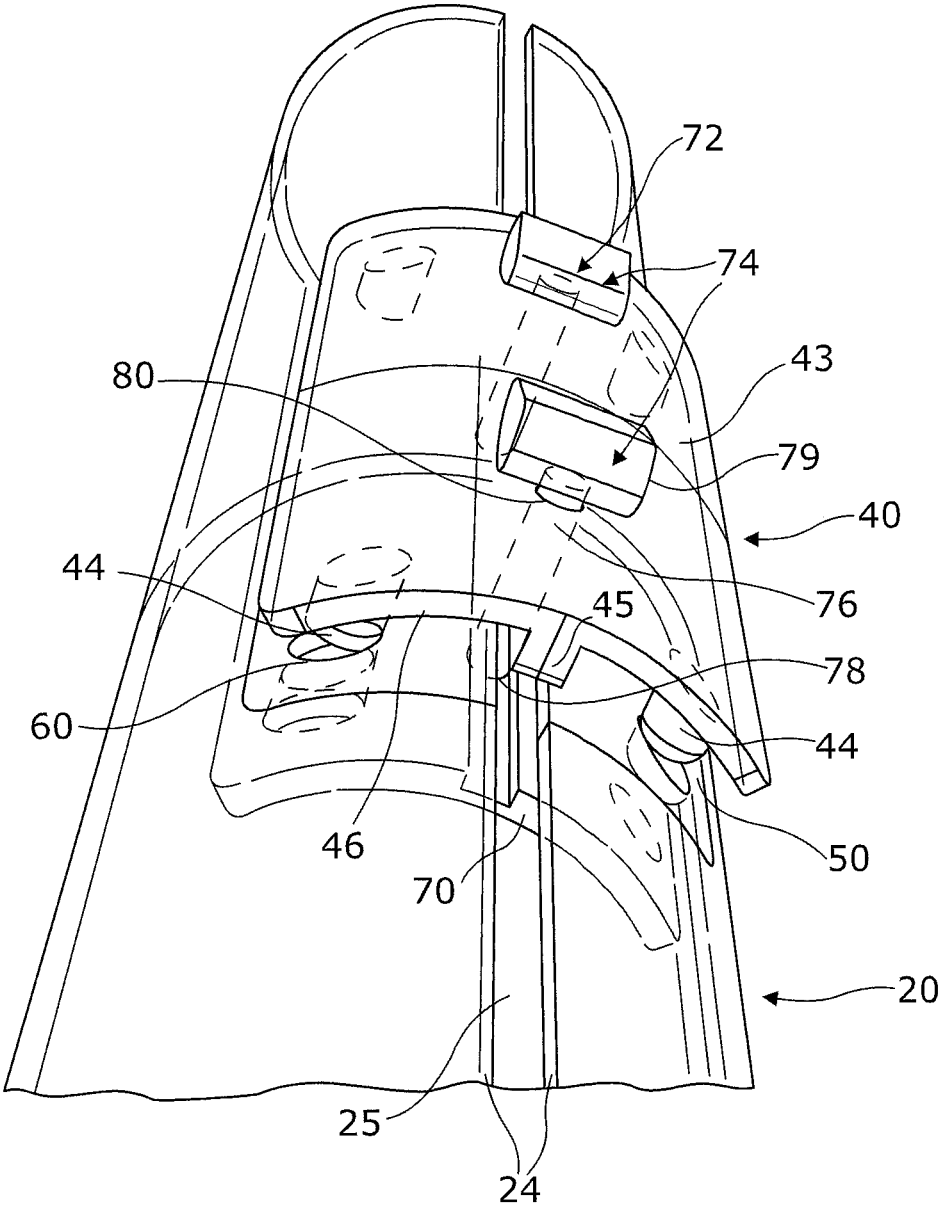
FIG. 7 shows a perspective view of another example of a slit locking clamp according to an embodiment of the present invention and suitable for use in the mast assembly of FIG. 1 prior to engagement with a STEM.

An alternative to a clamp using a collar arrangement is to use a face to face clamp, as shown in FIG. 7. The clamp 40 has an engagement portion comprising a body 43 with an engagement surface 46 similar to that in FIG. 3. Thus, the surface 46 is profiled to match the outer surface profile of the STEM 20 and has a longitudinal feature 45 for engaging with the slit 25 and protrusions 44 for engaging with holes 60 in the wall of the STEM 20. However the clamping mechanism to lock the engagement portion in position is different from FIG. 3. The body 43 in this example is relatively flat, as it does not need to provide a pivot. Instead, a second body 70 is disposed below the body 43 inside the STEM 20, which approximately following the foot print of the body 43 and having an outer profile adapted to follow the inner surface profile of the STEM 20. (FIG. 7 shows the mast in partial transparency so that the second body 70 can be seen.) A latch mechanism 72 is provided to clamp together the two bodies 43,70. The latch mechanism 72 comprises two latch members 74 in the form of arms 76 attached to the second body 70 via pivots 78 which extend through holes 80 in the first body 43 ending in a head portion 79.

Figure 8:
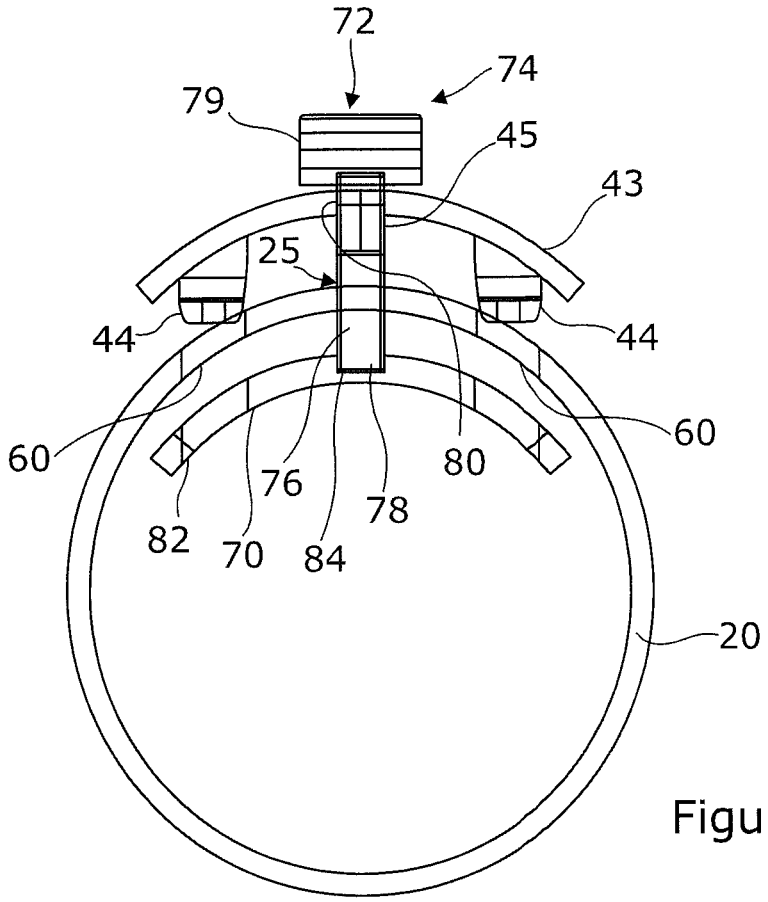
FIG. 8 shows in cross section the example of FIG. 7.
Figure 9:
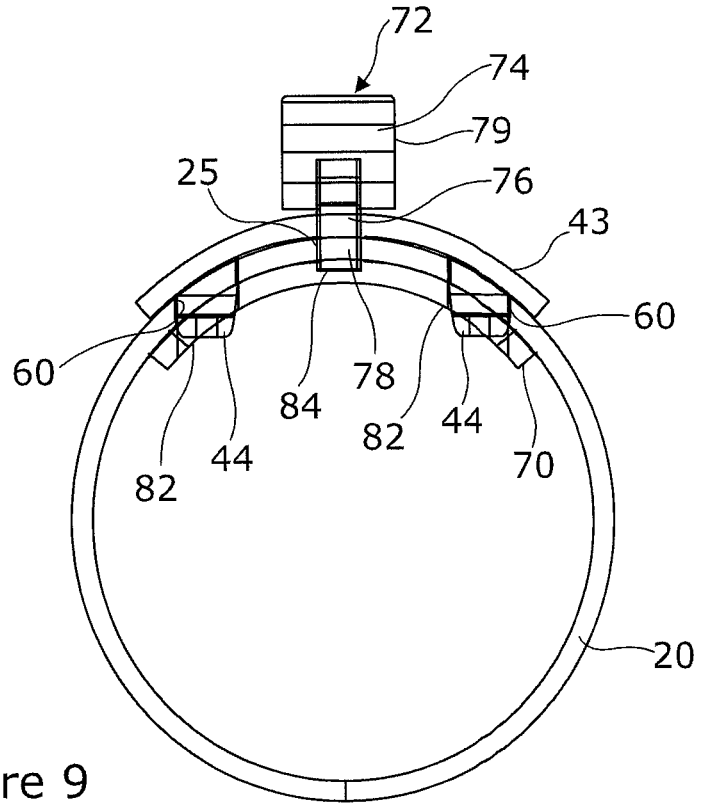
FIG. 9 shows in cross section the example of FIG. 7 with the clamp engaged with and clamping the STEM.

FIGS. 8 and 9 show the clamp 40 engaging with the STEM mast 20. The latch 72 is initially open as shown in FIG. 8. As the mast 20 is extended from the spool, as shown in FIG. 1, the mast transitions from flat to its tubular cross section. The clamp 40 is positioned with the side edges 24 of the STEM between its first and second body by sliding it along the STEM where the edges 24 of the STEM close together until it aligns with the desired clamping position 36,38,39. In this position, the arms 76 of the latch extend through the slit 24 in the tube, the longitudinal feature 45 is in the slit 24, and the protrusions 44 align with the holes 60 in the wall of the STEM 20. Accordingly, this form of clamp is not suitable for STEMs with overlapping edges.

To engage the latch 72, the arms 76 are pivoted outwards, thus drawing together the first and second bodies 43, 70 and clamping the clamp in position, as shown by FIG. 9. The second body 70 may have corresponding holes 82 for receiving the protrusions 44 extending through the holes 60 in the wall of the STEM 20 and a corresponding slit 84 for receiving the longitudinal feature 45 extending through the slit 25 of the STEM 20. This helps lock together the first and second bodies 43, 70 in accurate alignment and helps secure clamping of the edges 24 of the STEM 20.

This is in essence functionally identical to the collar of FIG. 3. Where it does not need to double in function as an attachment point for guy lines or other kit it could be advantageous in comparison to a collar, being potentially lighter, although it clearly needs access at a point where the two halves can be slid over the STEM edges and is not suitable for STEMs where the edges overlap. Any form of latch could be used, over-centre catches and screws being good candidates.

Alternatively or additionally, the STEM 20 could be provided with a featured edge 24 to allow an effective interlocked coupling and restrain relative movement of the edges 24. This could replace the need for holes in the STEM wall.

Figure 10:
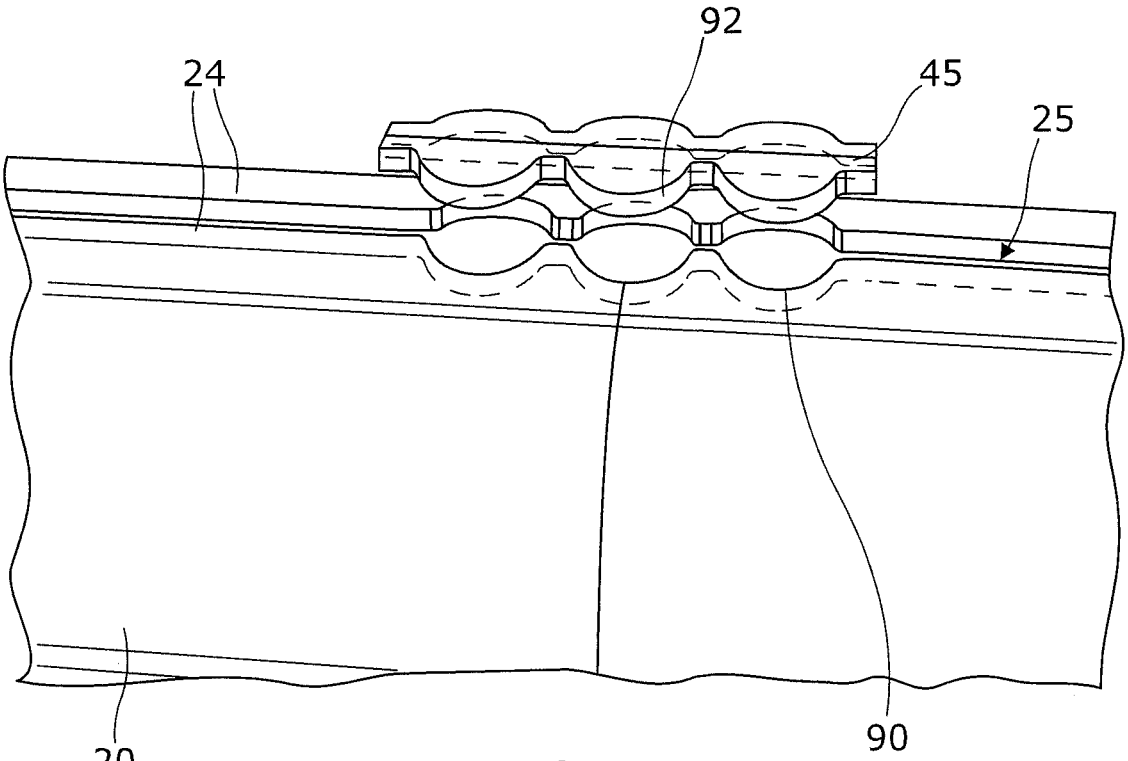
FIG. 10 shows a perspective view of another example of a slit locking clamp according to an embodiment of the present invention.

For example, as shown in FIG. 10, this may be done by producing a rebated feature 90 in the edges 24 of the slit 25, then giving the central rib 45 that sits into the slit 25 between the edges 24 a profile that matches the form of the rebated feature 90. By making the central rib 45 in a form of the type shown, we get a similar level of interlocking hold to that given by the protrusions 44 through holes 60 in the wall as shown by the example of FIG. 3. Rather than having separate holes on both sides of the slit 25 inboard of the edges 24, a single hole spanning the slit 25 is effectively formed. As with the example of FIG. 3, it is preferred rebated features 90 to extend a significant axial extent, i.e. at least 75% of the diameter of the STEM 20, or even 120% of the diameter or more. Any "saw tooth" pattern will work but smooth curves will tend to give a longer cycle life to the STEM 20, by minimizing stress concentrations.

Figure 11:
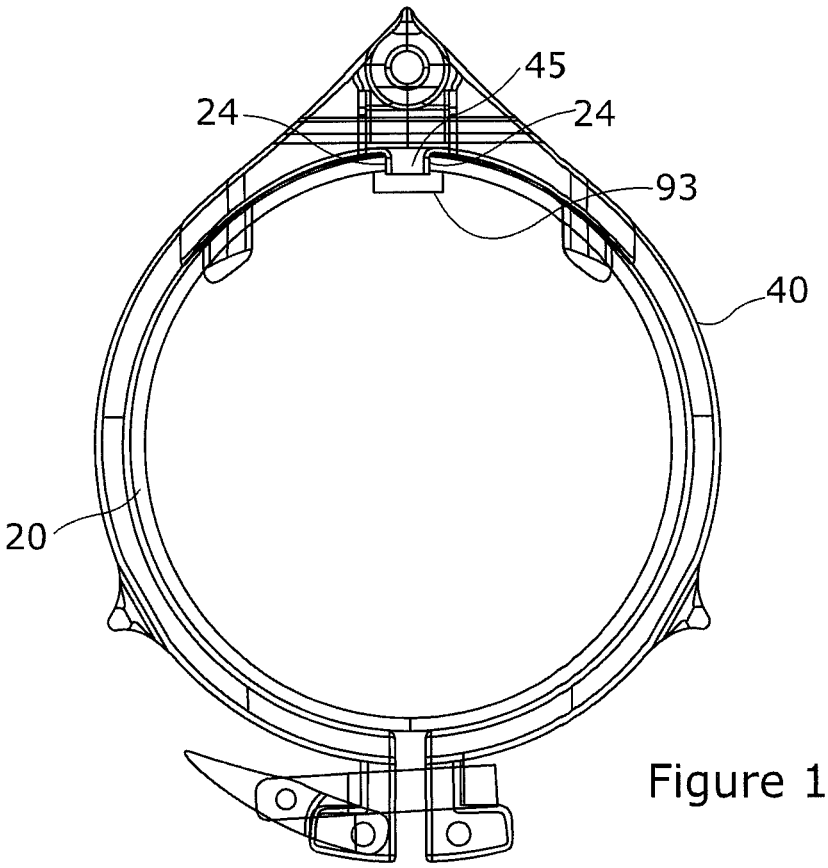
FIG. 11 shows in cross section another example of a slit locking clamp engaged with and clamping the STEM according to an embodiment of the present invention.

Another way in which the longitudinal feature 45 of the clamp 40 can be made to interact with the edges 24 of the STEM 20 is by having a portion 93 extend to some extent under the edges 24 onto the internal wall of the STEM 20, as shown in FIG. 11. This can be combined with protrusions or other features engaging on the face, as in FIG. 3, or with an interlocking central rib, as in FIG. 10, or both.

Figure 12:
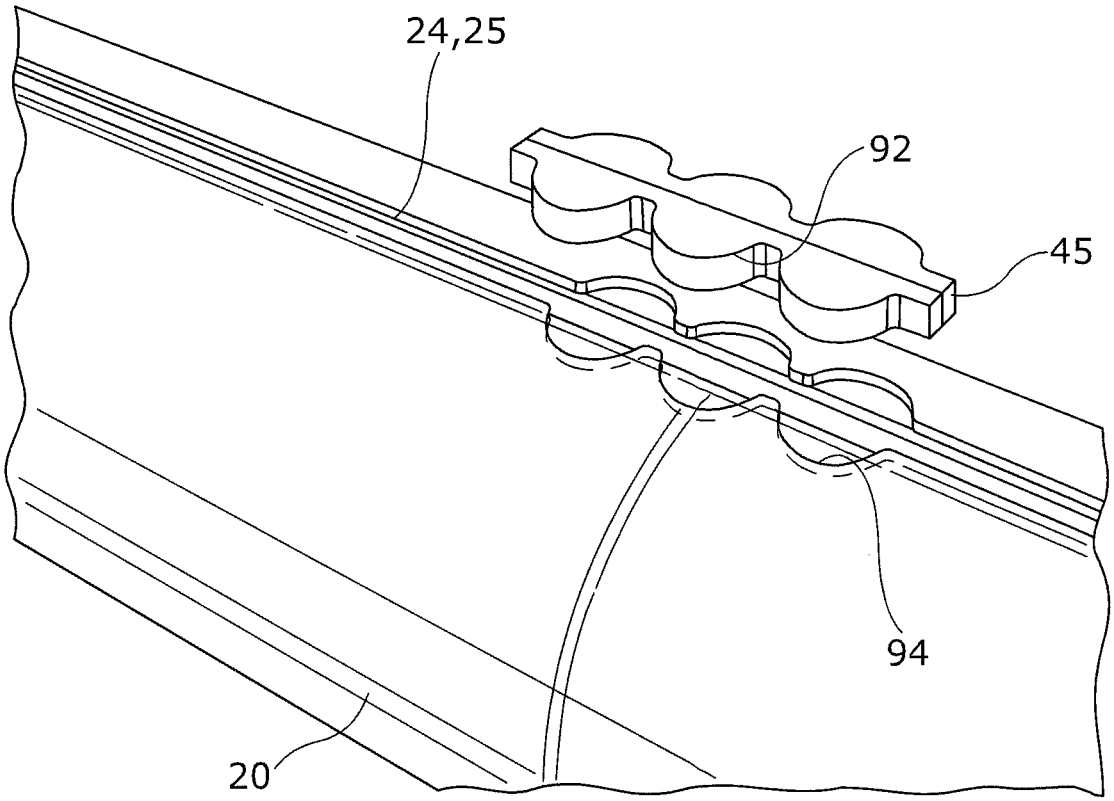
FIG. 12 shows a perspective view of another example of a slit locking collar according to an embodiment of the present invention.

In all the cases shown above there is no necessity for the features being made on the wall or edges of the STEM to go all the way through its wall. A protrusion type (allowing that protrusions may be of any cross section) could, for example, have protrusions that sit into a socket formed as a depression in the wall, rather than a through-hole. Edge features could, similarly, by produced as partial thickness rebates 94 as shown in FIG. 12. This arrangement may be useful for STEMs with no gap 25 between the edges where it is impractical to get a longitudinal feature within the slit 25.

This arrangement can be adapted for STEMs 20 with overlapping edges, where the uppermost edge can have a rebated feature 90 and the lowermost wall underneath the uppermost edge can have a corresponding hole or relief feature corresponding to the rebated feature 90, such that a protrusion or rib 45 from the clamp 40 can be received in the resultant hole to lock the walls together across the slit 25. In effect this combines a hole 60 as in the example of FIG. 3 with an edge feature 90,94 as in the examples of FIGS. 10 to 12 to interlock overlapping edges.

It will be appreciated that the interlocking arrangements described above may be inverted, i.e. with protrusions on the STEM 20, rebates or holes on the clamp 40.

By various combinations of these features we can define a wide range of collars and clamps that allow the mast to be stabilised and/or to act as a guy attachment point for tethers 18.

Figure 13:
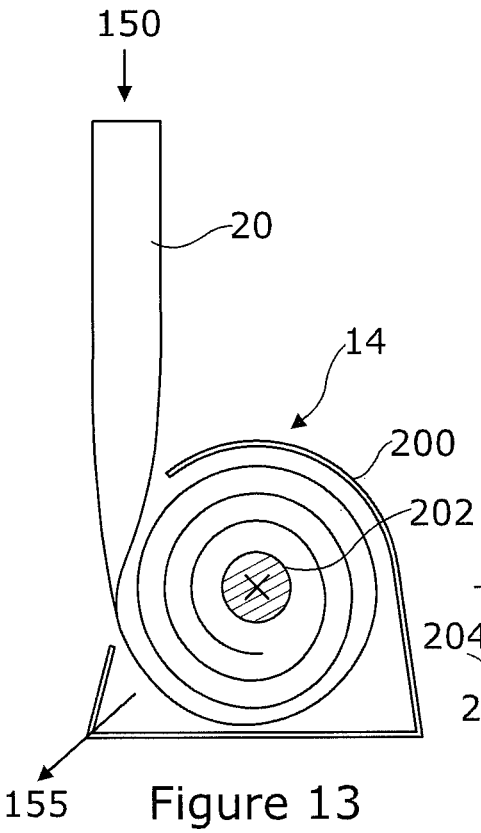
FIG. 13 shows an example of a mast being deployed from a dispenser according to an embodiment of the present invention.

Another possible failure mode occurs where the mast is partially deployed, i.e. in a partially extended form, e.g. from a dispenser 14, as shown in FIG. 1 where a portion of the mast 20 remains coiled in the dispenser 14 in the deployed state. The dispenser 14 may take the form of a "cage cassette" dispenser, as shown in FIG. 13, comprising two side plates 200, bridged by rods or rollers, and optionally a spool 202 rotationally fixed between the side plates 200 about which the mast is coiled. A further plate (not shown) may clamps in from the side on a screw, engaging on the edges of the coil to brake the coil. This generally gives good performance in deploying a range of masts.

However, as illustrated in FIG. 13, it is possible that the downward load (arrow 150) from guys and/or payload are sufficient to force the first turn off the coil at the base outward (arrow 155), leading to failure. Masts 20 with a larger diameter have a greater width across the coil and this may reach the point where the stressed areas 155 is exposed to sufficient force for the mast 20 to flex and fail under the load 150. Relatively high operating temperatures may lead to a reduction in stiffness that contribute to such failure. Clearly higher loads 150 also increase the risk of such failures. Failures of this type may also lead to damage to the mast 20 rendering it un-useable.

The issue does not apply when the STEM 20 is fully extended but it is advantageous to be able to deploy a STEM mast 20 at a range of extended lengths, this being one of the main advantages of a cassette/cage type dispenser system 14.

FIGS. 14 to 22 show examples of mast assemblies 10 including support assemblies 14 aimed at improving the resistance of the masts 20 to certain types of failure by the addition of support elements (in FIGS. 14 to 19 elements of the dispenser common to FIG. 13 are omitted for clarity), particularly those owning to compressive axial loads on the mast. In FIGS. 14 to 20 the support assemblies are provided by dispensers 14 for the mast where the dispenser 14 retains the coil as the free end to extends from the coil, whereas in FIGS. 21 to 22 the support assembly is a standalone unit which can be fitted to the already deployed mast. It should be noted that in these Figures the separation of the coils is generally exaggerated for clarity and that in practice a tighter coil would normally be present.

Figure 14:
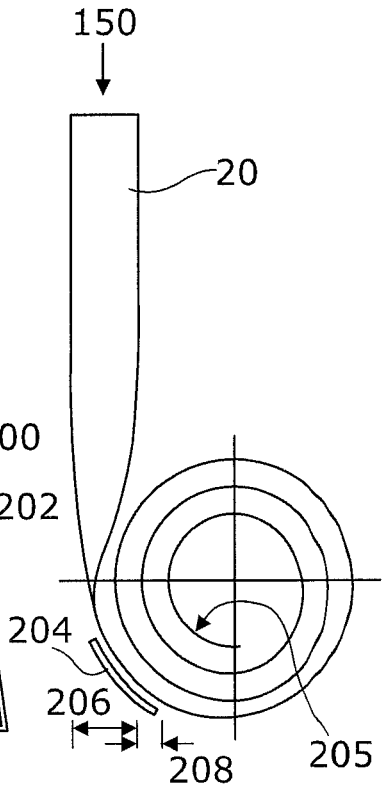
FIG. 14 shows another example of a mast being deployed from a dispenser according to an embodiment of the present invention.

FIG. 14 shows an example of a mast assembly 10 where the dispenser 14 additionally has a support element provided by a reaction plate 204 fixed between the side plates of the dispenser at a position where the mast 20 begins to transition from a flat form (in cross section) to its non-flat form (in cross section) as it extends and assumes its tubular shape, such that its surface contacts and supports the mast 20 at this point to react the forces involved. The plate 204 is positioned adjacent the extrados face of the coil to prevent it from being forced outwards. The surface of the plate 204 may be curved to follow the curved surface of the STEM 20 at this point. Generally, some form of braking is preferred to resist axial loads causing the mast to retract into the coil, and so that the axial load instead is carried by the mast and transferred at least partially to the reaction plate. This for instance may be combined with pressure plate braking along the edges of the coil or spindle 202 to fix the rotational position of the coil, and would produce a significant improvement in performance.

The run of STEM from the extended mast 20 to the coil is generally uninterrupted such that the loads acting on the mast 20 are directed generally towards the reaction plate 204. More particularly, the reaction plate 204 is preferably positioned in the quadrant 205 under the coil and adjacent to the transition from the coil to the extended mast. In other words, when the coil in side view is notionally divided into quadrants centred on the centre of the coil by lines parallel and perpendicular to the extension direction of the member, the reaction plate 204 is in the quadrant which is furthest from the extended mast in the parallel direction and closest to the extended mast in the perpendicular direction. Thus, with the mast 20 in a vertical deployment, the reaction plate 204 is generally positioned under the coil directly under the mast. The mast in this quadrant benefits most from additional support from the reaction plate 204. In this quadrant, as shown, the mast at least partially transitions from its flat, coiled form to its non-flat, extended form. This section of the coil is also opposite the axial load on the mast and is therefore expected to experience peak strains, i.e. most vulnerable to being forced out of its normal shape by the load.

The plate 204 may extend across all or some of the quadrant, or in some cases beyond the quadrant boundaries, either continuously or in discrete elements. Where the plate 204 extends across only some of the quadrant, it is preferred that the plate 204 overlaps at least partially with the footprint 206 of the mast and preferably extending some way beyond this 208 in the direction of the coil to provide further support to the flat portion of the STEM. It will be appreciated that these principles in positioning the reaction plate extend to other forms of support elements as described in the following.

Figure 15:
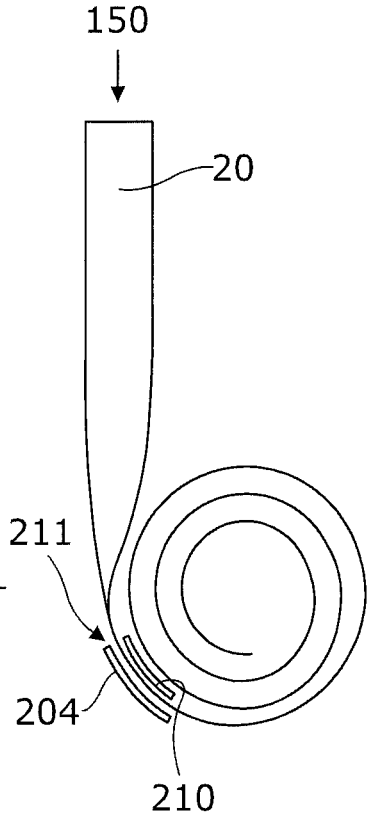
FIG. 15 shows another example of a mast being deployed from a dispenser according to an embodiment of the present invention.

Additionally, as shown in FIG. 15, a second support element in the form of reaction plate 210 may be provided adjacent the intrados face of the mast 20, generally opposite the first plate 204, to form a slit 211 or channel through which the mast 20 passes. This will give further integrity, as the mast 20 is now well supported against distortion or failure in any plane at the point of key stress by the two plates 204,210. The performance of the slit 211 in supporting the mast 20 may be further improved by forming all or part of the top section of the slit 211, i.e. towards the extended part of the mast, such as to follow all or part of the transition section of the mast 20, i.e. the secondary curvature developed by the mast as it transitions from the flat cross section it has when coiled into the tubular form it has when extended. Thus the bottom section of the slit 211, i.e.

towards the coil, is generally flat. Thus, the slit 211 helps support the mast as it transitions.

This could again be combined with the edge clamping brake, or any other suitable form of brake for preventing further rotation of the spool 202.

Figure 16:
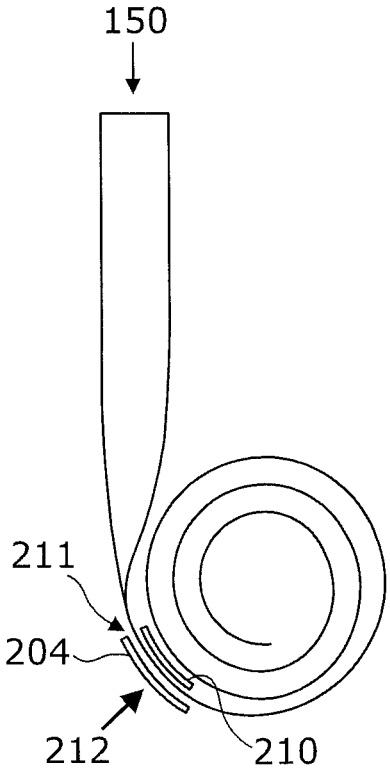
FIG. 16 shows another example of a mast being deployed from a dispenser according to an embodiment of the present invention.

Optionally, one or both reaction plates 204,210 may be modified to incorporate the braking action in the support at the point of stress by making part of the slit movable such as to clamp the mast 20. For instance, as shown in FIG. 16, the extrados plate 204 is configured to be movable 212 to clamp the mast 20 between the plates 204,210. This will both brake the mast 20 at the desired degree of extension and provide even better support for the mast 20 at the key point of stress, by actively clamping it rather than providing a support that still allows some flexion. Alternatively, in the example of FIG. 17, a cam 214 is pivoted to one of the plates, in this example the intrados plate 214, so as to have a first position allowing the mast 20 to move in the slit, and being pivotable to a second position where cam 214 protrudes towards the opposite plate 204 clamping the mast 20 against the opposite plate 204 and braking the mast at the desired extension. This provides a quick-release action with high integrity. The cam 214 could be formed as a short element, or run all or a substantial part of the width of the mast 20. The cam 214 could take the form of an eccentric member pivoted to the plate 210 or a roller on an arm pivoted to the plate 210.

Figure 18:
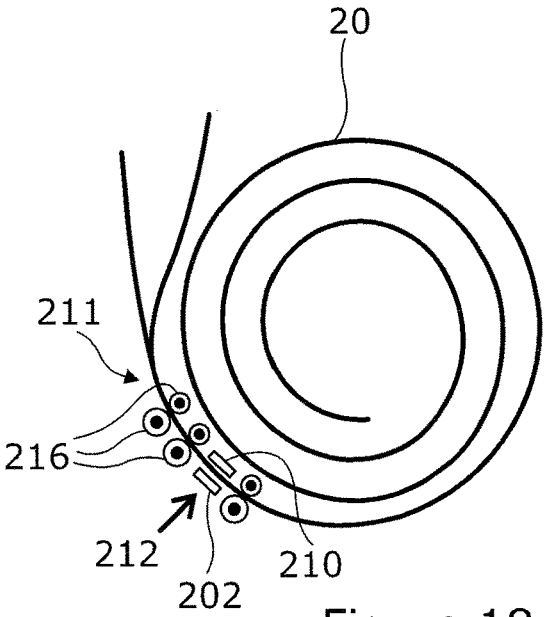
FIG. 18 shows another example of a mast being deployed from a dispenser according to an embodiment of the present invention.

It will be apparent that a large number different support elements can be used to support the mast and in various combinations. In the above examples, plate like elements 204,210 are used to guide and support the mast as it transitions off the coil. Alternatively or additionally, rollers or rods of any profile could be used as support elements to provide the support, combined with any form of brake. In the example of FIG. 18, rollers 216 are provided on the extrados and intrados faces of the mast 20 to support the mast 20 and are combined with plate elements 204,210 on the extrados and intrados faces of the mast 20, where one of the plates is movable to brake the member 20. In other examples (not shown), one or more rollers or bars can oppose a plate member to support the mast 20.

Figure 19:
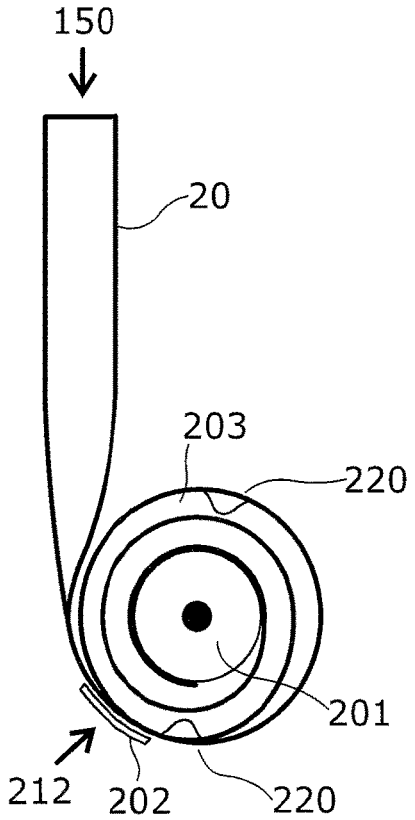
FIG. 19 shows another example of a mast being deployed from a dispenser according to an embodiment of the present invention.
Figure 20:
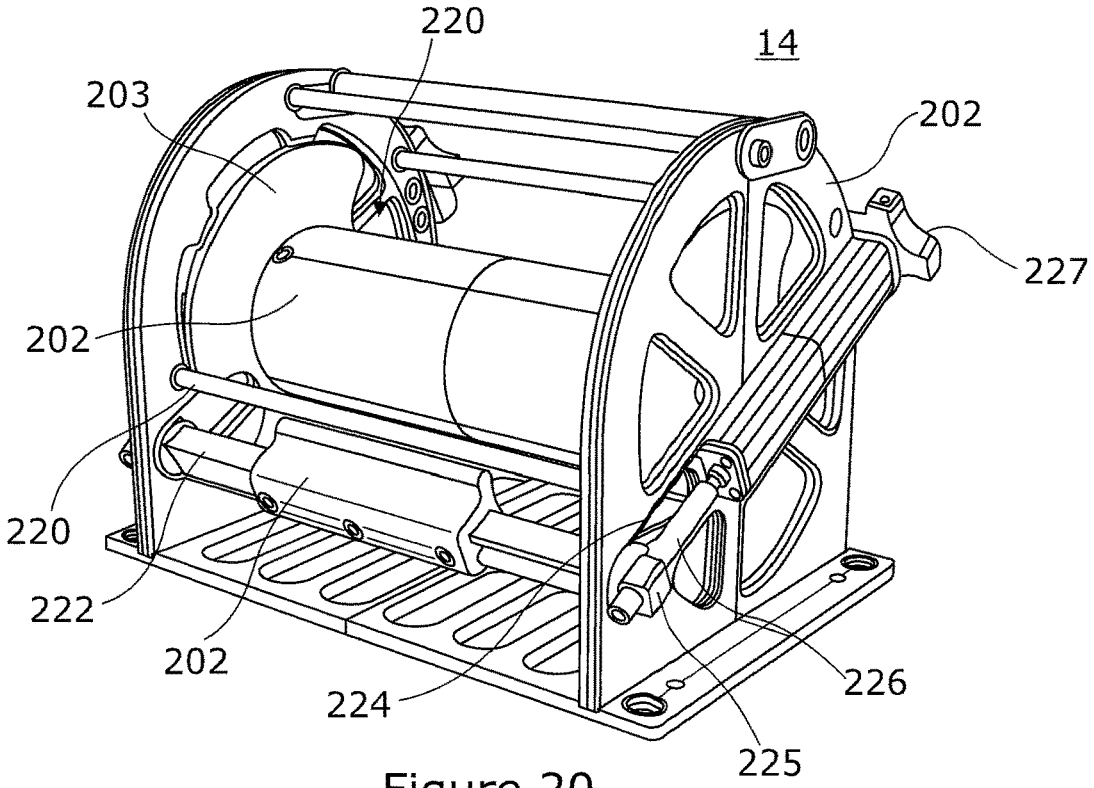
FIG. 20 shows another example of a mast being deployed from a dispenser according to an embodiment of the present invention.

FIGS. 19 and 20 shows an example of a dispenser 14 for deploying a mast 20. As shown in FIG. 19, the mast 20 is coiled on a spool 202 having extending side flanges 203 with one or more cut-out portions 220 on each side (other elements of the dispenser 14 are omitted for clarity). A support plate 202 is provided at the extrados face of the mast.

FIG. 20 shows the spool 202 rotationally mounted to a cage-like housing 200 (with the mast 20 omitted for clarity). The support plate 204 is attached to a bar 222 that extends across the width of the housing 200 protruding at each side through a slit 224 in the side of the cage which extends in a radial direction relative to the axis about which the spool 202 is rotationally mounted. The protruding ends each have a threaded hole 225 for receiving receive a respective threaded rod 226. The plate 204 can be drawn radially inwards 212 towards the spool 202 by rotating the threaded rods 226 by way of knobs 227 attached to their ends.

Figure 17:
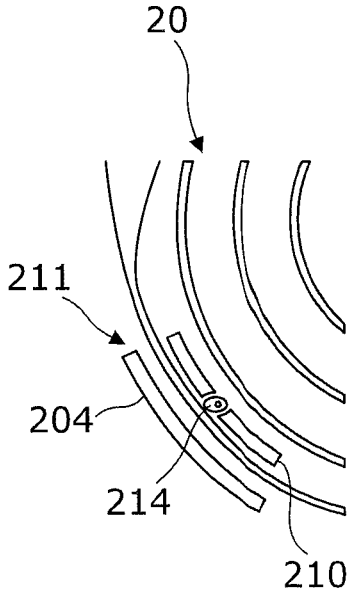
FIG. 17 shows another example of a mast being deployed from a dispenser according to an embodiment of the present invention.

In order to brake the spool 202, the spool 202 must be rotationally positioned such that cut-outs 220 at the sides of the spool 203 are aligned with the rod 222. The user then activates the brake by turning the knobs 227 such that the rod 222 enters into the cut-outs 220 preventing the spool 202 from rotating further. At the same time, the plate 204 is urged against the mast 20 at the transition point to help support it. If desired, a second plate 210 (as shown in FIGS. 15 to 17) can also be attached to the threaded rods 226 to create a slit 211 that can be drawn radially inwards as the brake is applied.

Thus, in summary, the support element or elements 204, 210,216 act to support the mast 20 at the point of maximum strain when transitioning from the coil to the extended form and so prevent the force of the mast and its load from distorting the mast at this point, and may be integrated with a brake to prevent the mast from coiling under load or any other forces acting to coil the mast when in use. The supporting elements may be single sided or support from both faces. It will typically be combined, or integrated with, a means for locking the STEM in position, i.e. some form of brake. The supporting elements may comprise one or more rigid pieces, or may comprise rollers, wheels or any other structure that can react the forces as described. The dispenser may optionally include a central drum to which the end of the mast is attached and that rotates as the mast is raised and lowered to act as a spool for the coiled mast. It may be integrated with a brake, by clamping against other supporting features or by clamping the transition point on the mast against the residual coils on a reel, or otherwise supported to prevent the residual coils from moving and thus failing to react the clamping force or forces. It may be completely separate from any braking or locking mechanism, although some degree of resistance to the forces causing the mast to coil will normally be desirable in most applications.

The dispensers 14 of any of FIGS. 13 to 20 are suitable for the mast assemblies 10 herein described in deploying masts at intermediate positions. In examples where a brake is provided, the user can extend the mast 20 to a desired height before engaging the brake. This may be done when the mast is at the desired height for end operation. Alternatively or additionally, the mast may be braked when it has extended to a position where a clamp 40 is to be attached to the mast 20, such that the user is free to attach the clamp without having to keep the mast 20 at that extended position, and vice versa when stowing the mast.

In the examples above, the mast 20 is manually deployed by cranking the spool or pulling on the free end to extend the mast 20 from the coil and/or manually applying the brake at a desired extension. However, it will be appreciated that the spool 202 and/or the brake 204,214 can be powered, e.g. by electrical, pneumatic or other powered motors or actuators, and/or automatically controlled, e.g. by a programmed control computing device or electrical circuit (not shown). Automation may similarly be provided to attach clamps to the mast as it is extended, using, for example, a sensor to detect the positions on the mast where the clamps are to be applied.

Figure 21:
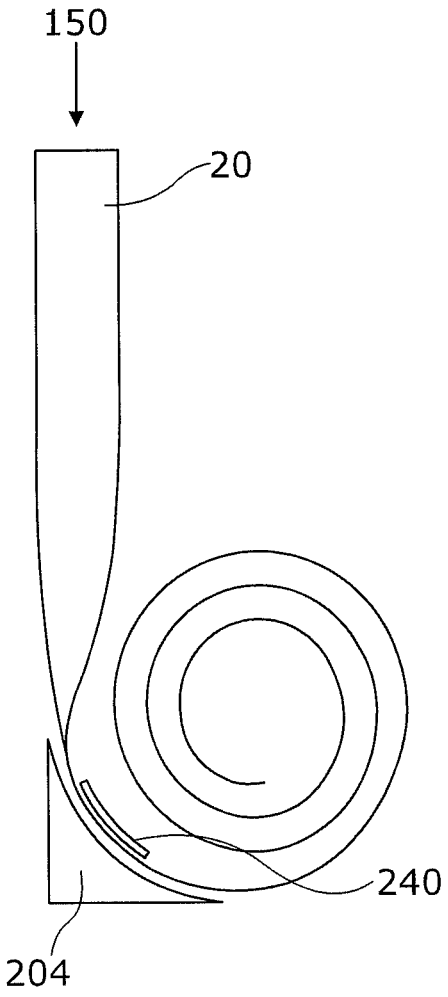
FIG. 21 shows an example of a mast deployed with a support assembly according to an embodiment of the present invention.

In other examples, the benefits of supporting the lower quadrant of the coil of the mast may be achieved without the support elements being incorporated into a dispenser. In other words, the mast can be uncoiled to a partially extended state before it is coupled to a support assembly which include support elements to support the coil. For instance, FIG. 21 shows a partially deployed mast 20 where the quadrant of the coil is supported by a wedge shaped support element 204, which may for instance be secured to the ground when the mast is deployed. Preferably the wedge has a concave surface adapted to match the curve of the coil over the quadrant. A positioning element is preferably provided for positioning the coil and preventing the coiled section of the BRC from rolling out. This could be as simple as a number of "pegs" driven into the ground or weights placed against the bottom of the STEM opposite the "wedge".

In the example of FIG. 21, the support structure includes a "wedge" with one or more features 210 that can clamp the last turn of the STEM to the wedge 204 and so keep the coil in position. Alternatively, the "clamp" could secure the wedge to all or any number of turns on the coil. This could be done by sliding the wedge 204 into position then sliding one or more clamping/securing elements 210 into position in the interstitial space in the coil from the side edge. As long as there is sufficient friction in the system the clamping of the STEM into position can be secure even with little or no pressure exerted on the STEM or even with a slight gap between them.

Figure 22:
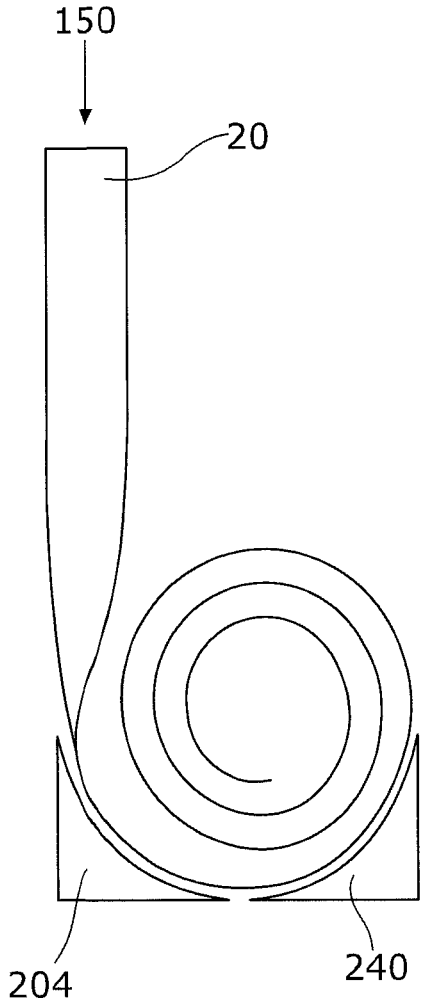
FIG. 22 shows another example of a mast deployed with a support assembly according to an embodiment of the present invention.

In other examples, the support elements may subtend more or less of the curve of the bottom section of the partly deployed STEM. In the example of FIG. 22, the support assembly includes a wedge under the quadrant where the mast transitions and a second wedge supporting the opposite quadrant under the coil, so as to position the coil. In this case, friction alone may prevent the mast from retracting into the coil under the load 150 on the mast 20, or it may be combined with a clamp feature 210 as for example shown in FIG. 21. The wedges may be provided in two or more pieces, as shown, or as a single, joined piece.

As will be appreciated, many of the principles described above in relation to the dispensers of FIGS. 13 to 20 can be applied to the support assemblies, e.g. the way that the coils can be braked. The main difference between the support assemblies of FIGS. 21 and 22 and the dispensers 14 of FIGS. 13 to 20 is that the support assembly is "open" or "openable" allowing it to be fitted to the coil of the already partially deployed mast, whereas the dispenser 14 has the coil as an integral part, e.g. attached to a spool, which is not intended to be separated from the housing, but is allowed to rotate in the housing when the mast is extended. As the dispenser is arranged to allow the coil to rotate fairly freely, it is normally desired to include a brake to prevent retraction of the deployed mast under a load 150. Whereas in a support assembly a brake may not be necessary as friction between the mast and support assembly may be made sufficient to prevent retraction under load.

Embodiments of the present invention have been described with particular reference to the example illustrated. However, it will be appreciated that variations and modifications may be made to the examples described within the scope of the present invention.

The invention claimed is:

1. A mast assembly, comprising:

an extendible mast constructed and arranged so as to be configurable between a coiled form and an extended form, wherein when extended the mast is resiliently biased in the form of an elongate tube having a slit along a longitudinal extent defined by first and second longitudinal edges of the mast and wherein when coiled the mast is opened out at the slit to a flattened cross section and wound into a coil about an axis extending transversely to the longitudinal extent of the mast; and, at least one slit locking clamp for clamping across the slit in the mast at a discrete position along the length of the extended mast so as to stabilize the first longitudinal edge relative to the second longitudinal edge, the clamp being removable from the mast when not clamping across the slit in the mast, wherein the slit locking clamp has at least one feature for engaging with a corresponding feature of the mast on one or both sides of the slit to resist movement of the first longitudinal edge relative to the second longitudinal edge when clamping the mast, wherein the at least one feature of the clamp comprises at least one of:

a protrusion which is received by a corresponding hole or recess on the mast, and a hole which receives a corresponding protrusion of the mast.

2. The mast assembly of claim 1, wherein a further feature of the clamp is a longitudinal feature arranged to fit in the slit and maintain separation of the first and second longitudinal edges of the mast when clamped.

3. The mast assembly of claim 2, where the longitudinal feature has a profile arranged to interlock with corresponding indents or relief portions at the first and second longitudinal edges of the mast.

4. The mast assembly of claim 2, wherein the longitudinal feature extends through the slit and widens, thereby forming grooves which receive the first and second longitudinal edges of the mast.

5. The mast assembly of claim 1, wherein the clamp has engagement features that have an axial separation or, where continuous, extend axially for a distance equal to at least 75% of the diameter of the mast.

6. The mast assembly of claim 1, wherein an internal surface of the clamp is adapted to follow an external profile of the mast.

7. The mast assembly of claim 1, wherein friction between the clamp and the mast acts to resist axial movement of the first longitudinal edge relative to the second longitudinal edge.

8. The mast assembly of claim 1, further comprising a plurality of clamps at different axial positions along the length of the mast.

9. The mast assembly of claim 1, wherein at least one clamp has an attachment feature for connecting at least one tether configured to further stabilize the mast when deployed.

10. The mast assembly of claim 1, further comprising a dispenser holding the coil of the mast.

11. A mast assembly comprising:

an extendible mast constructed and arranged so as to be configurable between a coiled form and an extended form, wherein when extended the mast is resiliently biased in the form of an elongate tube having a slit along a longitudinal extent defined by first and second longitudinal edges of the mast and wherein when coiled the mast is opened out at the slit to a flattened cross section and wound into a coil about an axis extending transversely to the longitudinal extent of the mast; and at least one slit locking clamp for clamping across the slit in the mast at a position along the length of the mast so as to stabilize the first longitudinal edge relative to the second longitudinal edge, wherein the clamp comprises first and second collar members pivoted relative to each other, such that they can be opened out to encircle the mast, and a fixture arranged to join ends of the first and second collar members to form a collar around the tube.

12. A method of deploying a mast assembly, the method comprising:

extending a mast from a coiled form to an extended form, wherein, in the extended form, the mast is resiliently biased in the form of an elongate tube having a slit along a longitudinal extent defined by first and second longitudinal edges of the mast and wherein, in the coiled form, the mast is opened out at the slit to a flattened cross section and wound into a coil about an axis extending transversely to the longitudinal extent of the mast; and clamping at least one slit locking clamp across the slit in the mast at a discrete position along the extended length of the mast so as to stabilize the first longitudinal edge relative to the second longitudinal edge before further extending the mast, wherein the clamp is separate from the mast before being clamped across the slit in the mast, wherein the slit locking clamp has at least one feature for engaging with a corresponding feature of the mast on one or both sides of the slit to resist movement of the first longitudinal edge relative to the other second longitudinal edge when clamping the mast, wherein the at least one feature of the clamp comprises at least one of:

a protrusion which is received by a corresponding hole or recess on the mast, and a hole which receives a corresponding protrusion of the mast.

13. The method according to claim 12, further comprising positioning the clamp with respect to the mast such that at least one locking feature of the clamp is aligned with and engages with a corresponding feature of the mast before closing the clamp.

14. A method according to claim 12, further comprising closing a collar of the slit locking clamp around the extended mast.

15. The method according to claim 12, further comprising clamping the mast at plural positions along the longitudinal extent as the mast is extended.

16. The method according to claim 12, further comprising extending the coil from a dispenser and operating a brake of the dispenser to lock the mast at a desired height.

* * * * *